US012234636B2

(12) United States Patent
Strickland

(10) Patent No.: US 12,234,636 B2
(45) Date of Patent: Feb. 25, 2025

(54) LIGHT STEEL FRAMING PLENUM

(71) Applicant: UnitiWall Corporation, Mississauga (CA)

(72) Inventor: Michael R. Strickland, Richmond Hill (CA)

(73) Assignee: UnitiWall Corporation, Mississauga (CA)

( * ) Notice: Subject to any disclaimer, the term of this patent is extended or adjusted under 35 U.S.C. 154(b) by 207 days.

(21) Appl. No.: 17/896,795

(22) Filed: Aug. 26, 2022

(65) Prior Publication Data

US 2022/0412075 A1 Dec. 29, 2022

Related U.S. Application Data

(63) Continuation-in-part of application No. 16/820,400, filed on Mar. 16, 2020, now Pat. No. 11,428,002.

(60) Provisional application No. 62/819,278, filed on Mar. 15, 2019.

(51) Int. Cl.

| | |
|---|---|
| ***E04B 1/74*** | (2006.01) |
| ***E04B 1/76*** | (2006.01) |
| *E04B 1/24* | (2006.01) |

(52) U.S. Cl.

CPC ..... *E04B 1/76* (2013.01); *E04B 2001/2415* (2013.01); *E04B 2001/2418* (2013.01)

(58) Field of Classification Search

CPC ..... E04B 2001/2415; E04C 2/292

See application file for complete search history.

(56) References Cited

U.S. PATENT DOCUMENTS

| | | | | |
|---|---|---|---|---|
| 3,943,674 | A * | 3/1976 | Ray | E04F 15/02423 52/126.6 |
| 4,074,488 | A * | 2/1978 | Ray, III | E04F 15/02405 52/126.6 |
| 4,561,233 | A * | 12/1985 | Harter | E04F 13/12 52/522 |
| 4,633,634 | A * | 1/1987 | Nemmer | E04B 2/62 52/282.1 |
| 5,355,649 | A * | 10/1994 | Berridge | E04F 13/0889 52/394 |
| 5,524,400 | A * | 6/1996 | Schmechel | E04B 1/14 52/236.7 |
| 5,853,512 | A * | 12/1998 | McKinney | B29C 44/18 264/46.7 |
| 6,568,144 | B2 * | 5/2003 | Meredith | E04B 1/08 52/656.1 |

(Continued)

*Primary Examiner* — Basil S Katcheves

(74) *Attorney, Agent, or Firm* — DLA PIPER LLP (US)

(57) ABSTRACT

A light steel framing plenum includes a horizontal plenum member, a vertical plenum member and plurality of screws. The horizontal plenum member includes a pair of horizontal plenum flanges and horizontal plenum web. The horizontal plenum flanges have dimpled screw holes formed therein. The vertical plenum member is attached to the horizontal plenum member. The vertical plenum member has a pair of vertical plenum flanges and a vertical plenum web therebetween. Each vertical plenum flange has a step formed therein for receiving the horizontal flange from the attached horizontal plenum member. A plurality of screws are provided to attach the horizontal plenum member to the vertical plenum member. The lights steel framing plenum provides a generally flat surface for attachment thereto.

1 Claim, 28 Drawing Sheets

(56) References Cited

U.S. PATENT DOCUMENTS

| | | | | |
|---|---|---|---|---|
| 8,146,314 | B2 * | 4/2012 | Nguyen | E04B 1/14 52/762 |
| 8,453,404 | B2 * | 6/2013 | Cox | E04C 2/384 52/309.7 |
| 9,340,972 | B2 * | 5/2016 | Naidoo | B32B 13/02 |
| 2007/0144090 | A1 * | 6/2007 | Nguyen | E04B 1/14 52/251 |
| 2015/0093982 | A1 * | 4/2015 | Bailey | H01M 50/224 454/184 |
| 2015/0330096 | A1 * | 11/2015 | Geller | E04H 9/024 52/167.5 |
| 2016/0237683 | A1 * | 8/2016 | Husin-Ali | E04C 2/284 |
| 2019/0078326 | A1 * | 3/2019 | Glen | B32B 15/14 |

* cited by examiner

LIGHT STEEL FRAMING PLENUM

FIELD OF THE DISCLOSURE

This disclosure relates to light steel framing plenums and in particular light steel framing panels that provide a flat surface for attachment thereto.

BACKGROUND

Exterior insulated panel systems are becoming more common in multi-story curtain wall construction. When these panels are properly designed and installed, they provide optimum thermal protection for the building. However, the current method of installing such panel systems requires a lot of specialized trades on the job site. The current insulated panel system has a number of layers all of which are installed on site.

Accordingly, it would be advantageous to provide a panel system that can be made off site.

SUMMARY

The thermally separated composite panel assembly includes a steel panel, a thermal separation layer, a plenum and cladding. The plenum is operably attached to the thermal separation layer. The cladding is operably attached to the plenum. The steel panel defines the size of the thermally separated composite panel. The steel panel has an outer perimeter and the outer perimeter of the plenum is in registration therewith. The thermally separated composite panel assembly may have a single window therein or a plurality of windows. A plurality of thermally separated composite panels when used together will form a wall.

The thermal separation layer may include a sheathing board operably attached to the steel panel and a plurality of spaced apart thermal separation blocks operably attached between the sheathing board and the plenum.

The separation blocks may snap onto the perimeter girts of the plenum.

The plurality of thermal separation blocks may be fastened through the sheathing board to the steel panel.

The thermal separation layer may include a continuous strip around the perimeter of the sheathing board adjacent to the plurality of separation blocks.

The thermal separation layer may include a sealant around the periphery of the continuous strip.

The sheathing board may be one of gypsum or plywood.

The thermal separation layer may include a metal sheathing and the metal sheathing may be operably attached to the steel panel with an inner continuous strip and operably attached to the plenum with an outer continuous strip.

The thermal separation layer may include a plurality of spaced apart thermal separation blocks operably attached between the metal sheathing board and the plenum.

The separation blocks may snap onto the perimeter girts of the plenum.

The plurality of thermal separation blocks may be fastened to the metal sheathing.

The thermal separation layer may include a sealant around the periphery of the inner continuous strip and the outer continuous strip.

The plenum further may include interior girts.

One of the interior girts may be a framing girt and the framing girt may include an inner flange, a web and an outer flange and the inner flange may have a plurality of spaced apart inner slots formed therein and a plurality of outer slits and the inner slots and the outer slits provide drainage.

The perimeter girts may have a perimeter girt outer face and the interior girts may have an interior girt outer face and the outer face of the interior girts is spaced inwardly of the perimeter girt outer face.

Insulation may span from between the thermal separation layer to the interior girts outer face.

The space between the perimeter girt outer face and the interior girt outer face may define an air cavity.

The plurality of perimeter girts may include a top perimeter girt, a bottom perimeter girt and opposed spaced apart perimeter side girts. The bottom perimeter girt may have a plurality of holes formed therein.

The thermally separated composite panel assembly may include at least one window and each of the steel panel, the thermal separation layer, the plenum and the cladding have a space formed therein for receiving the window.

Perimeter girts may surround each window.

The perimeter girts may be used internally in a horizontal position, and holes are located in the space provided for air and moisture movement.

The steel panel may be constructed of cold rolled steel members.

The thermally separated composite panel assembly may be a load bearing thermally separated composite panel assembly.

The steel panel may include peripheral vertical framing member and peripheral horizontal framing members and the vertical framing member may act as a vertical load bearing column.

The plenum may extend downwardly from the steel panel and an elongate weather flap may be operably attached to the plenum.

The thermally separated composite panel may be a multi-storied thermally separated composite panel.

A light steel framing plenum includes a horizontal plenum member, a vertical plenum member and plurality of screws. The horizontal plenum member includes a pair of horizontal plenum flanges and horizontal plenum web. The horizontal plenum flanges have dimpled screw holes formed therein. The vertical plenum member is attached to the horizontal plenum member. The vertical plenum member has a pair of vertical plenum flanges and a vertical plenum web therebetween. Each vertical plenum flange has a step formed therein for receiving the horizontal flange from the attached horizontal plenum member. A plurality of screws are provided to attach the horizontal plenum member to the vertical plenum member. The lights steel framing plenum provides a generally flat surface for attachment thereto.

The vertical member may further include a pair vertical web lips extending inwardly from the vertical web at each end thereof. Each horizontal web may include at least one dimpled screw hole formed therein. The light steel framing plenum may further include screws for attaching the pair of vertical web lips of the vertical plenum member to the horizontal web.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

Figure 1:
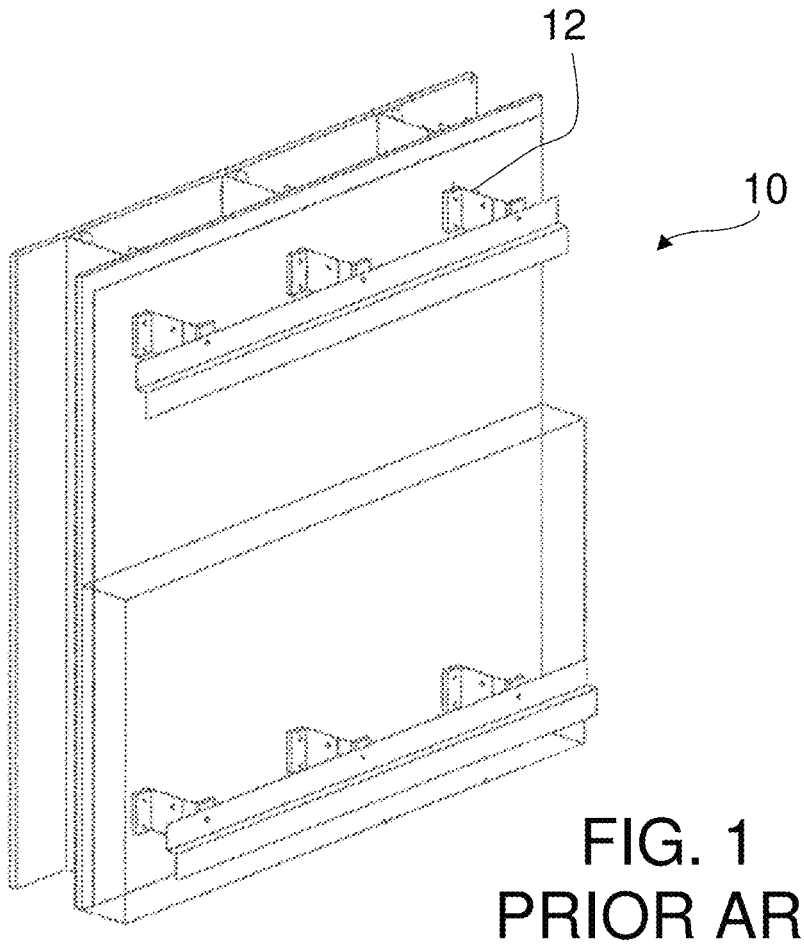
FIG. 1 PRIOR ART
FIG. 1 is a perspective view of the prior art thermal break wall system of U.S. Pat. No. 9,493,941.
Figure 2:
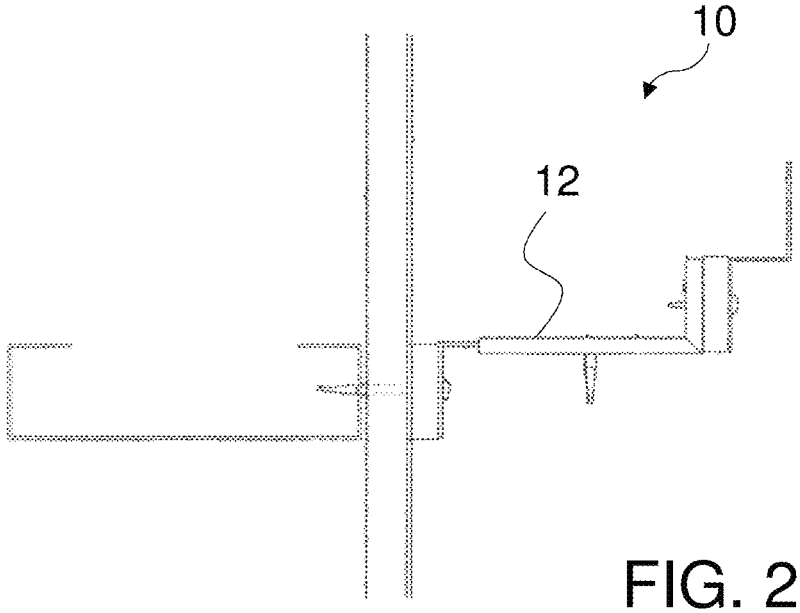
FIG. 2 PRIOR ART
FIG. 2 is a top view of the prior art thermal break wall system of FIG. 1.
Figure 3:
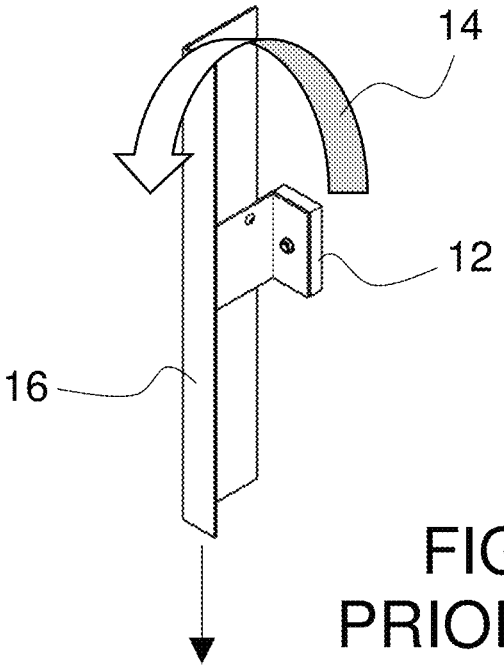
FIG. 3 PRIOR ART
FIG. 3 is a perspective view a vertical adjustable clip of the prior art thermal wall system of FIG. 1 showing the moment.
Figure 4:
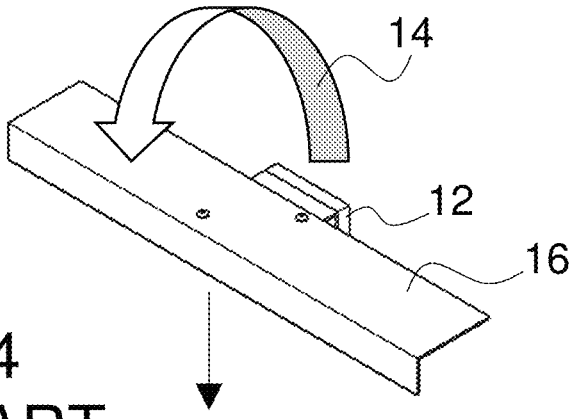
FIG. 4 PRIOR ART
FIG. 4 is a perspective view of a horizontal adjustable clip of the prior art thermal wall system of FIG. 1 showing the moment.

Referring to FIGS. 1 to 4, a prior art thermal break wall system is shown generally at 10. The description of this system is from U.S. Pat. No. 9,493,941 issued to White et al. on Nov. 15, 2016. While this prior art thermal break wall system provides a number of advantages over wall systems that came before it, there are still some disadvantages to this system. For example, the wall system 10 is generally installed in situ. Since the different layers are installed in situ, this necessitates a number of trades being available to install the different layers. Further as the building gets taller, there are a number of construction challenges since for example the different layers are installed from the outside of the building. Further, as shown in FIGS. 3 and 4 the standard prior art thermal clips 12 experience rotation 14 which creates higher pull-out loads on the fasteners 16. This means that more fasteners 16 are required in order to deal with these overturning moments created on the individual thermal clips 12.

Figure 5:
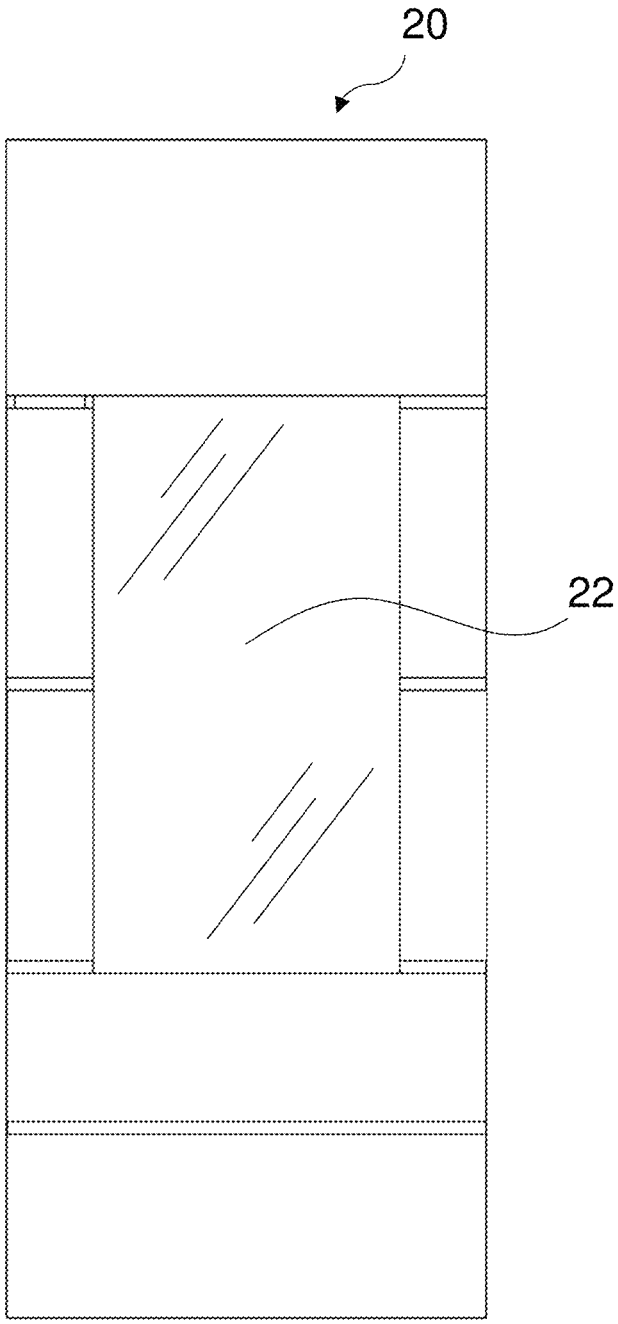
FIG. 5 is a front view of a thermally separated composite panel assembly with a window therein.
Figure 6:
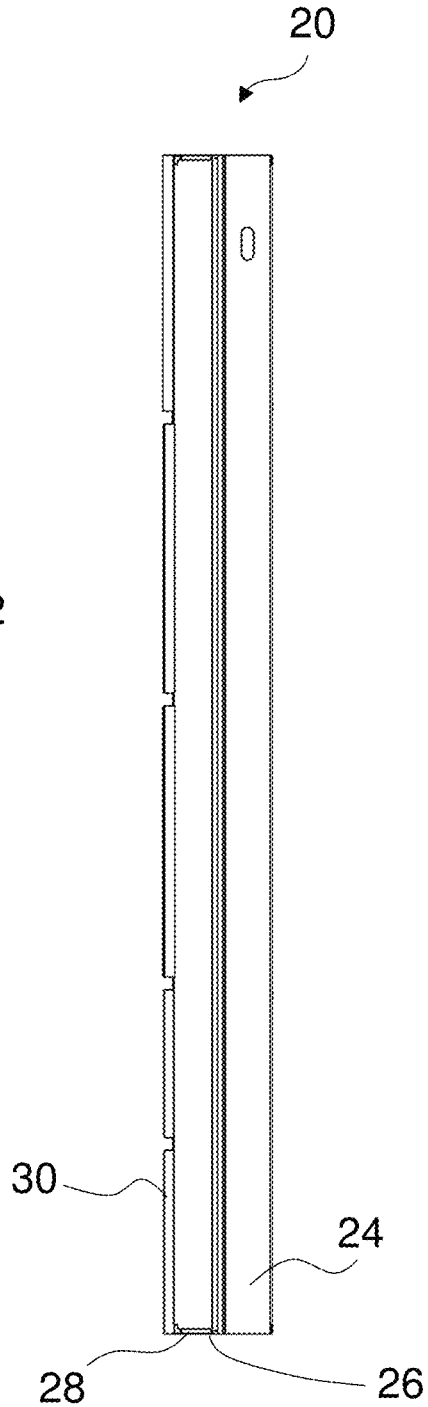
FIG. 6 is a side view of the thermally separated composite panel assembly of FIG. 5.
Figure 7:
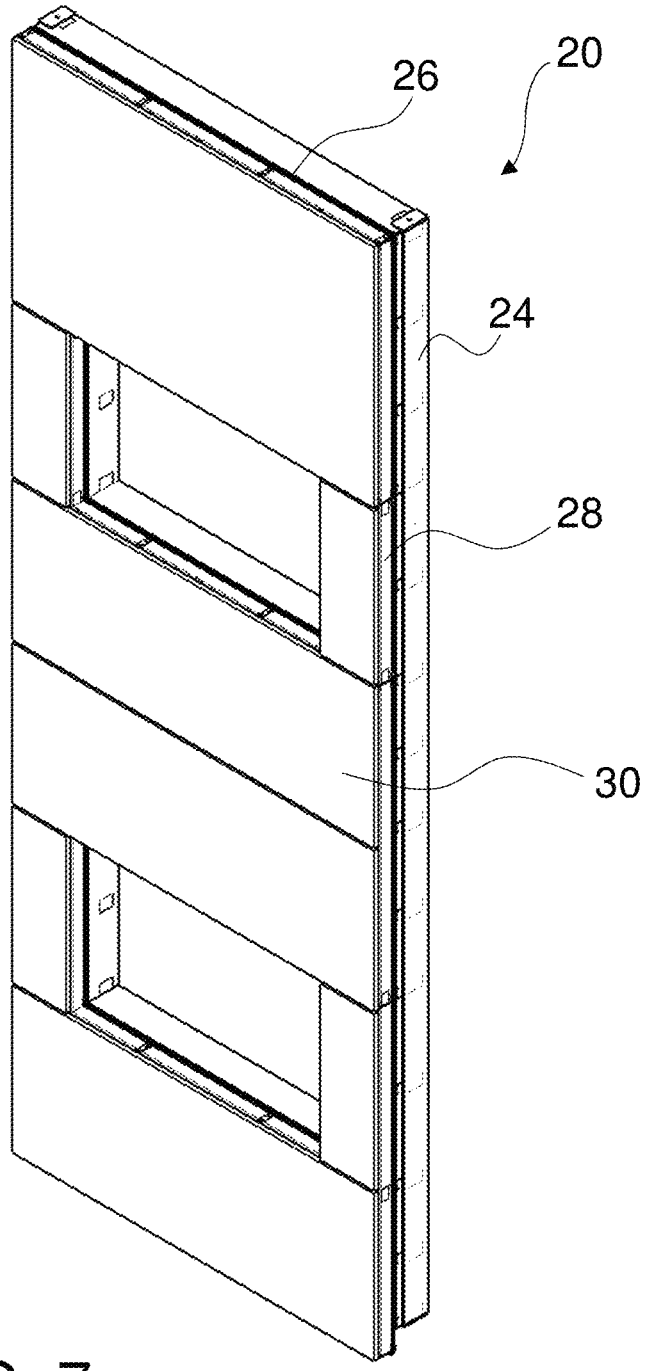
FIG. 7 is a perspective view of a thermally separated composite panel assembly similar to that shown in FIG. 5 but have a plurality of windows therein.
Figure 8:
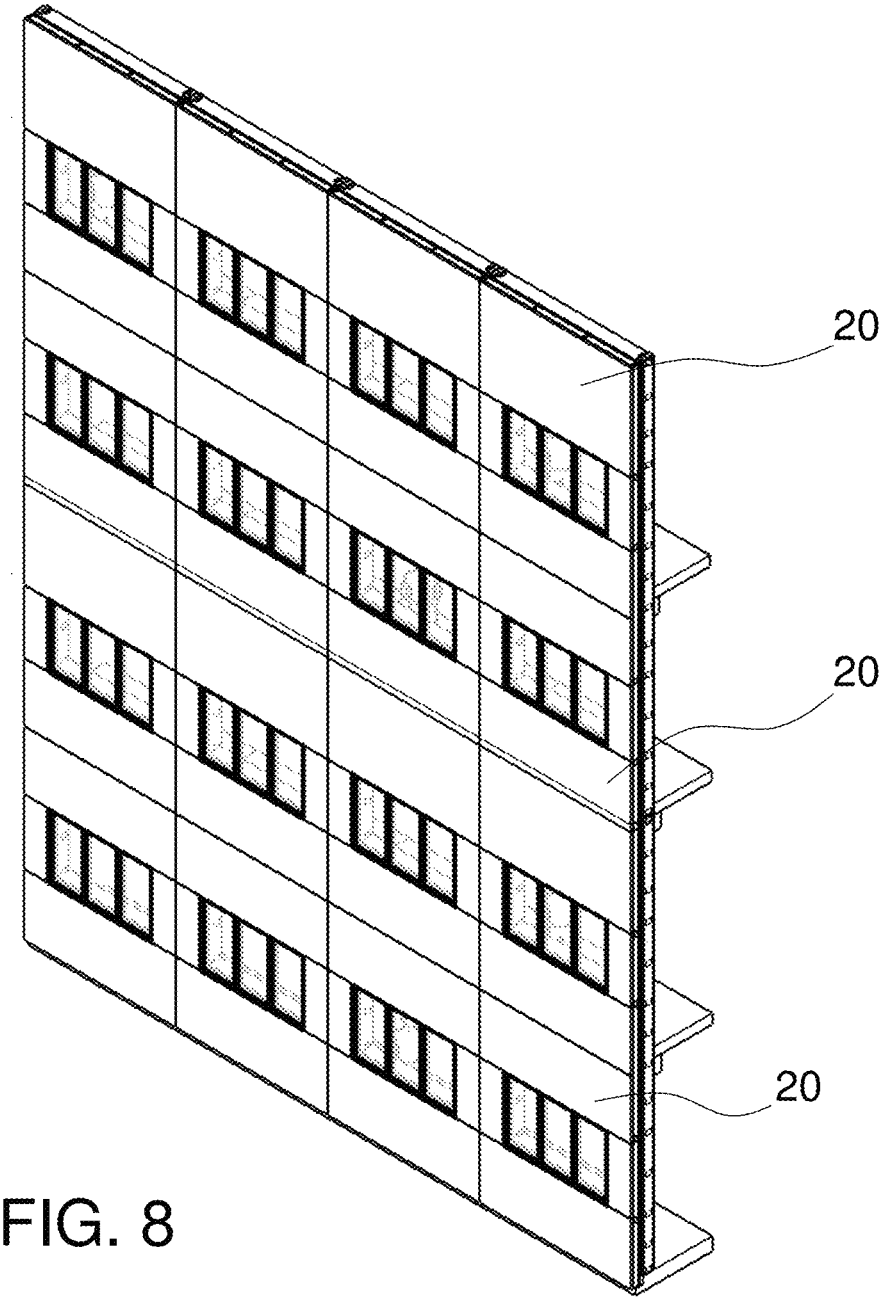
FIG. 8 is a perspective view of a wall of a building having a plurality of thermally separated composite panel assemblies similar to those shown in FIG. 7.

Referring to FIGS. 5 and 6 a thermally separated composite panel assembly is shown generally at 20. The thermally separated composite panel assembly 20 may include a window 22. The thermally separated composite panel assembly 20 includes a steel panel 24, a thermal separation layer 26, a plenum 28 and cladding 30. The plenum 28 is operably attached to the thermal separation layer 26. The cladding 30 is operably attached to the plenum 28. The steel panel 24 defines the size of the thermally separated composite panel assembly 20. The steel panel 24 has an outer perimeter and the outer perimeter of the plenum 28 is in registration therewith. Where there is a window or door, each of the steel panel 24, the thermal separation layer 26, the plenum 28 and the cladding 30 have a space formed therein for receiving the window or door. The thermally separated composite panel assembly 20 may have a single window 22 therein as shown in FIG. 5 or a plurality of windows 22. It will be appreciated by those skilled in the art that a plurality of thermally separated composite panel assemblies 20 when used together will form a wall as shown in FIG. 8.

Figure 9:
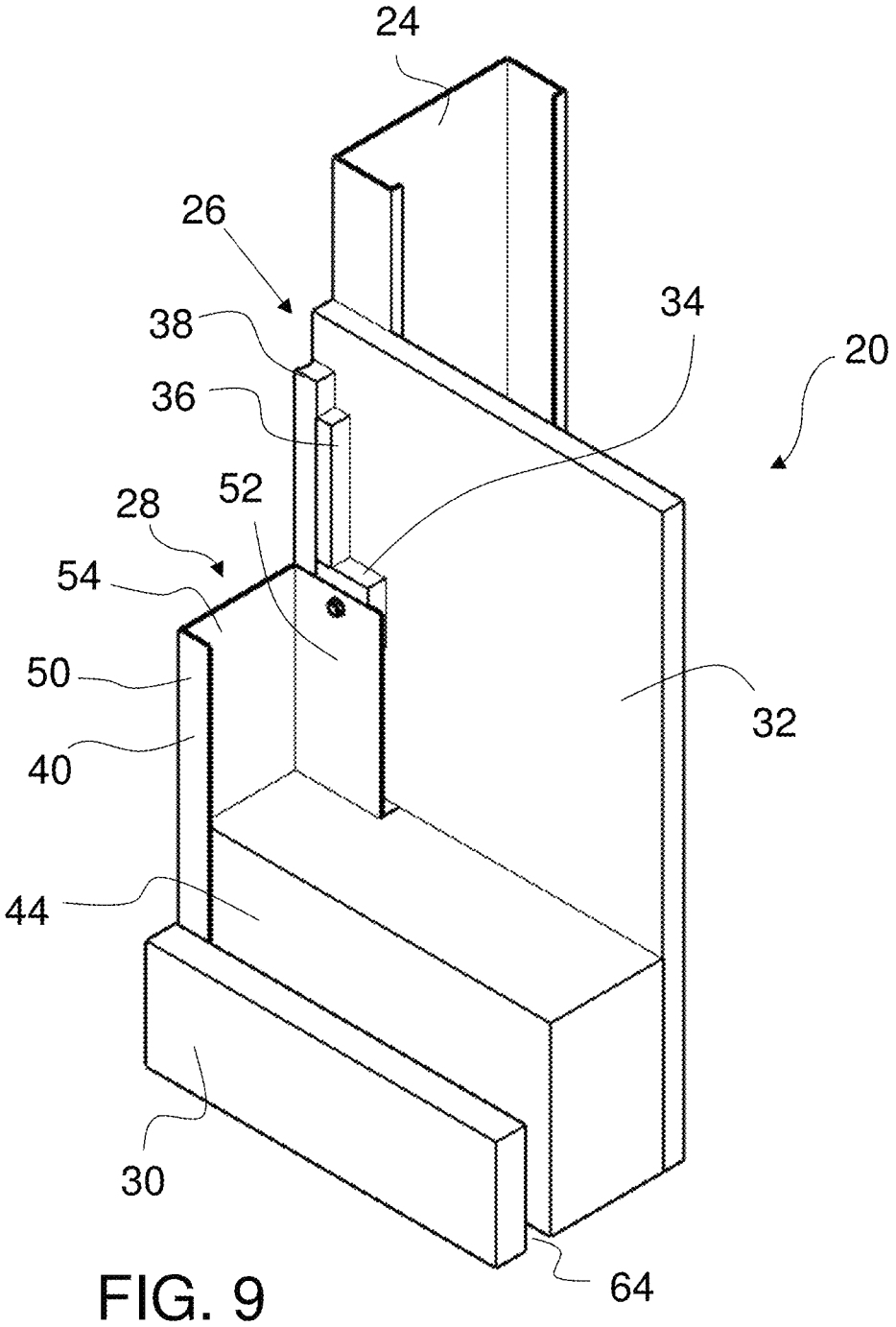
FIG. 9 is a broken apart perspective view of a thermally separated composite panel assembly.
Figure 10:
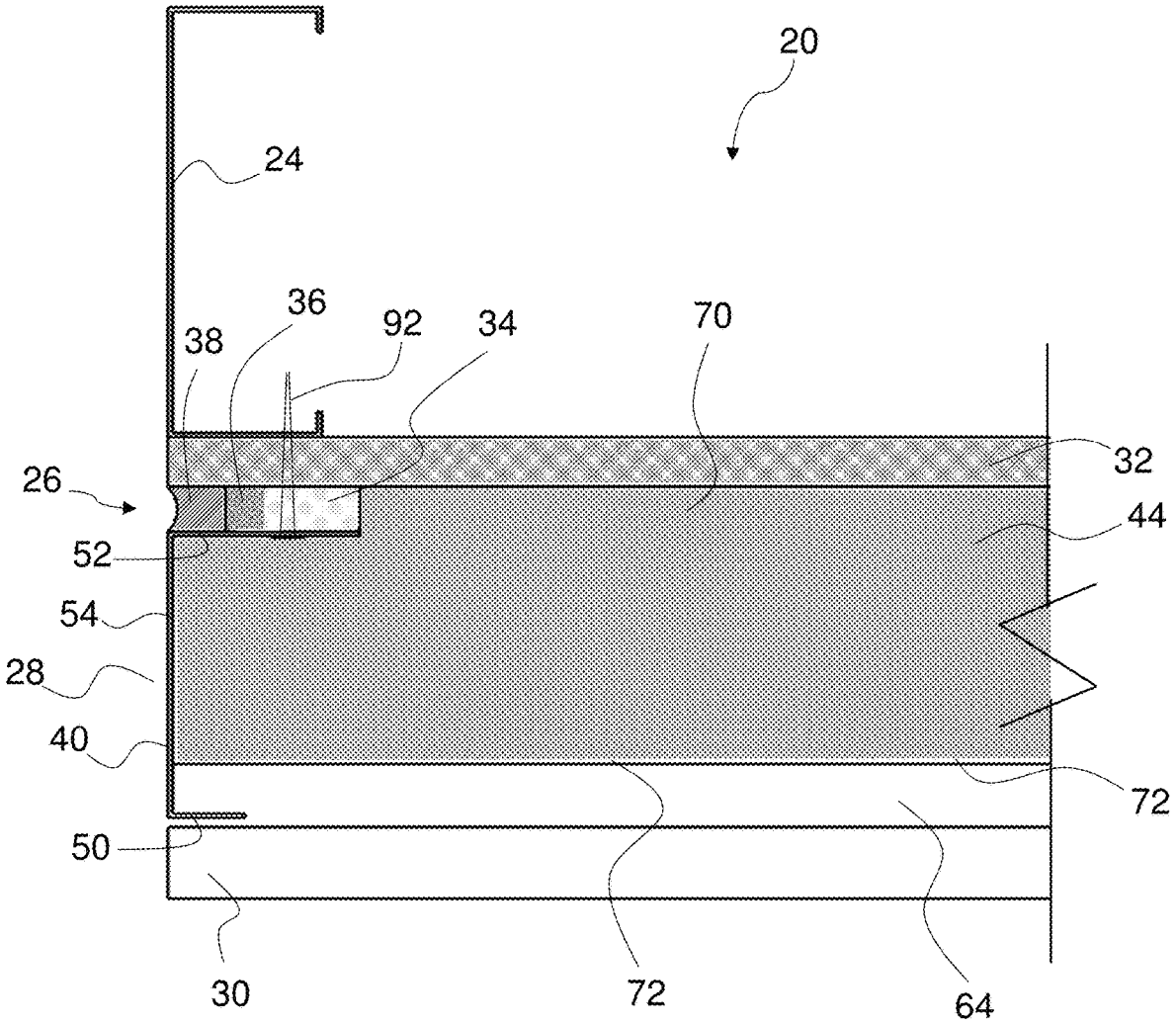
FIG. 10 is a sectional view of the thermally separated composite panel assembly of FIG. 9.
Figure 11:
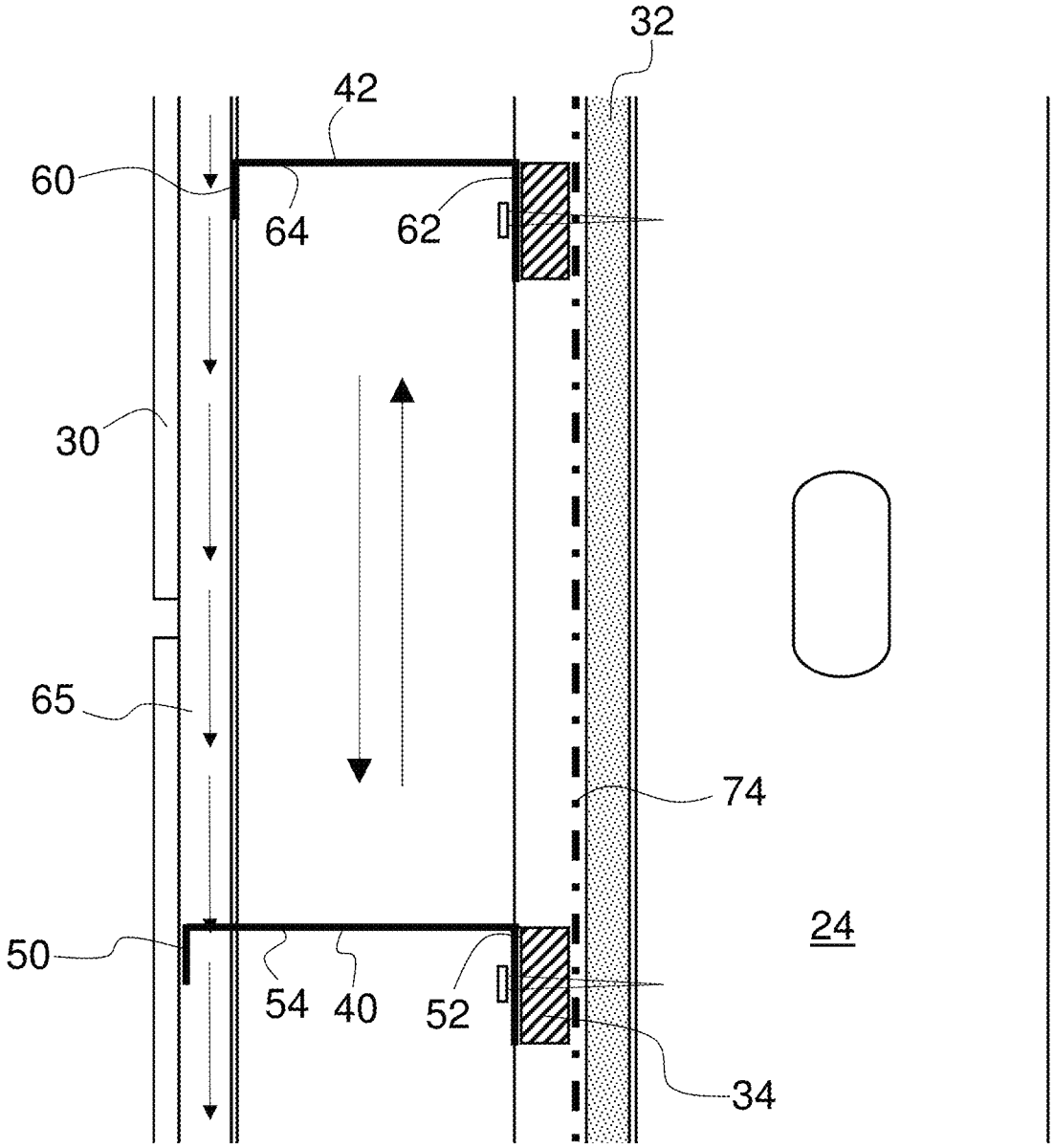
FIG. 11 is a partial vertical sectional view of the thermally separated composite panel of FIGS. 9 and 10.

The embodiment of the thermally separated composite panel assembly 20 shown in FIGS. 9 to 11 has a thermal separation layer 26 which includes a sheathing board 32, a plurality of spaced apart thermal separation blocks 34, a strip 36 and a sealant 38. The plurality of spaced apart thermal separation blocks 34 and the strip 36 together form a continuous perimeter around the perimeter of sheathing board 32. Typically, the strip 36 is a high strength open cell polyurethane foam strip that is compatible with silicon. Typically, the sealant 38 is a silicone caulking.

The plenum 28 includes a plurality of perimeter girts 40 and a plurality of interior girts 42 and insulation 44 as best seen in FIG. 11. The perimeter girts 40 are used around the periphery of the plenum and are in registration with the outer perimeter of the steel panel 24. The perimeter girts 40 are generally C shaped or L shaped members with a top flange or outer face 50, a bottom flange 52 and a web 54 therebetween. The bottom flange 52 is longer than the top flange. Similarly, the interior girts 42 are generally C shaped or L shaped members with a top flange or outer face 60, a bottom flange 62 and a web 64 therebetween. The outer face 60 of the interior girts 42 is spaced inwardly of the perimeter girt outer face 52. The space between the perimeter girt outer face 52 and the interior girt outer face 60 define an air cavity 65 as best seen on FIG. 11. The insulation 44 fills the space between the plurality of perimeter girts 40 and the plurality of interior girts 42. The insulation has an inner face 70 that is flush with the thermal separation layer 26 and an outer face 72 that is parallel with the interior girt outer face 60 as best seen in FIG. 10. Thus the insulation 44 does not extend into the air cavity 65. The air cavity 65 is also defined by the space between the insulation 44 and the cladding 30. The air cavity 64 provides space for air and moisture movement.

The perimeter girts 40 are used around the perimeter of the plenum 28. Perimeter girts 40 are also used around the perimeter of the windows, doors or other openings.

The sheathing board 32 may be gypsum, plywood or any other suitable board. The sheathing board 32 may have a moisture and air barrier 74 applied thereto as best seen in FIG. 11. Note in FIG. 11 the insulation is not shown so that the other features of the thermally separated composite panel assembly 20 may be more easily seen.

Figure 12:
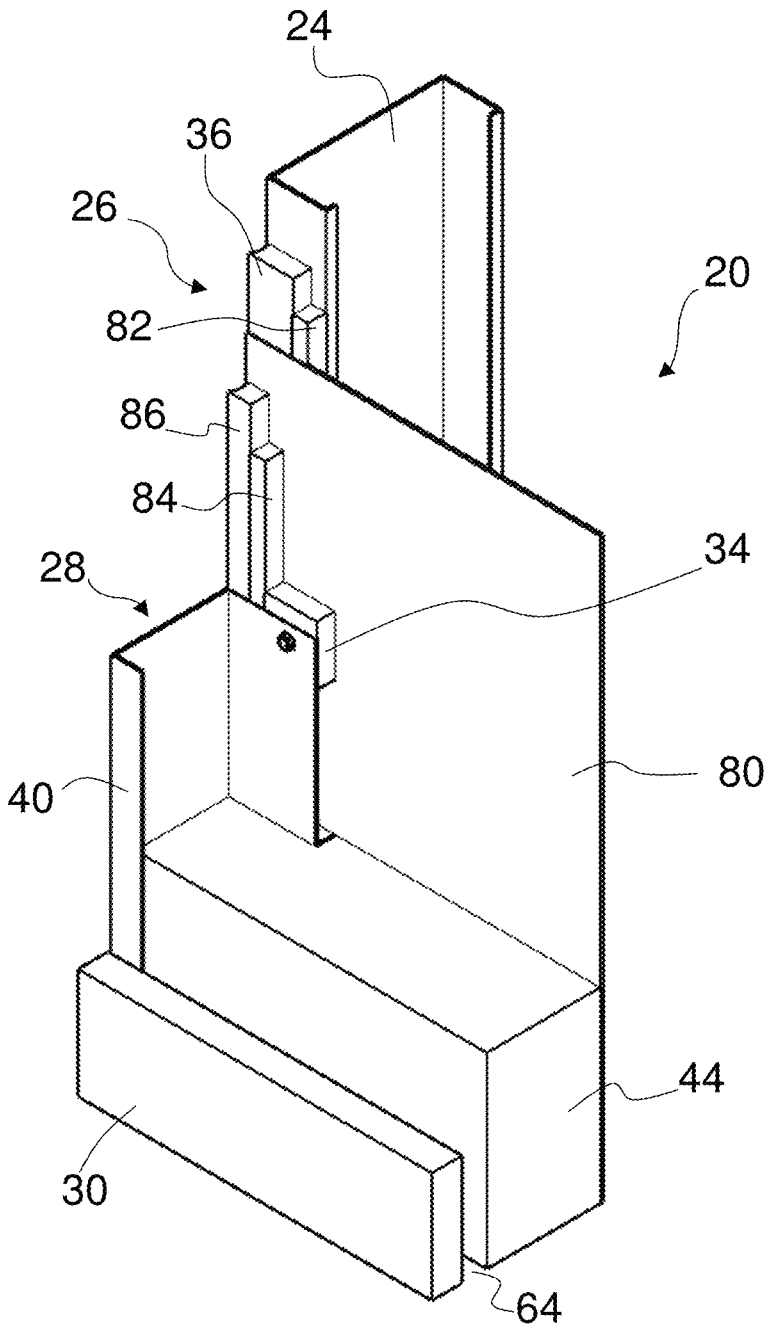
FIG. 12 is a broken apart perspective view of an alternate embodiment of a thermally separated composite panel assembly.
Figure 13:
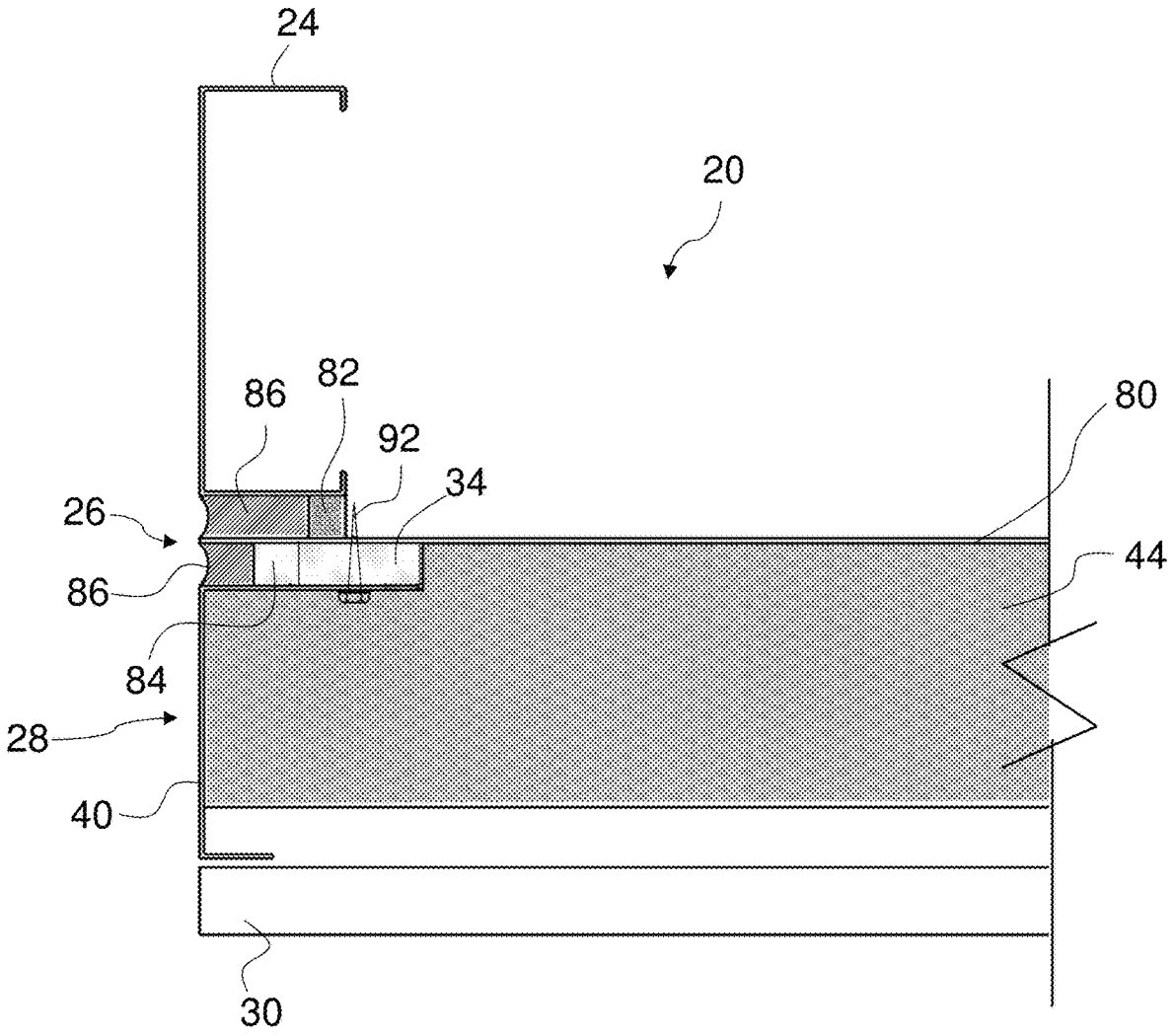
FIG. 13 is a sectional view of the thermally separated composite panel assembly of FIG. 12.
Figure 14:
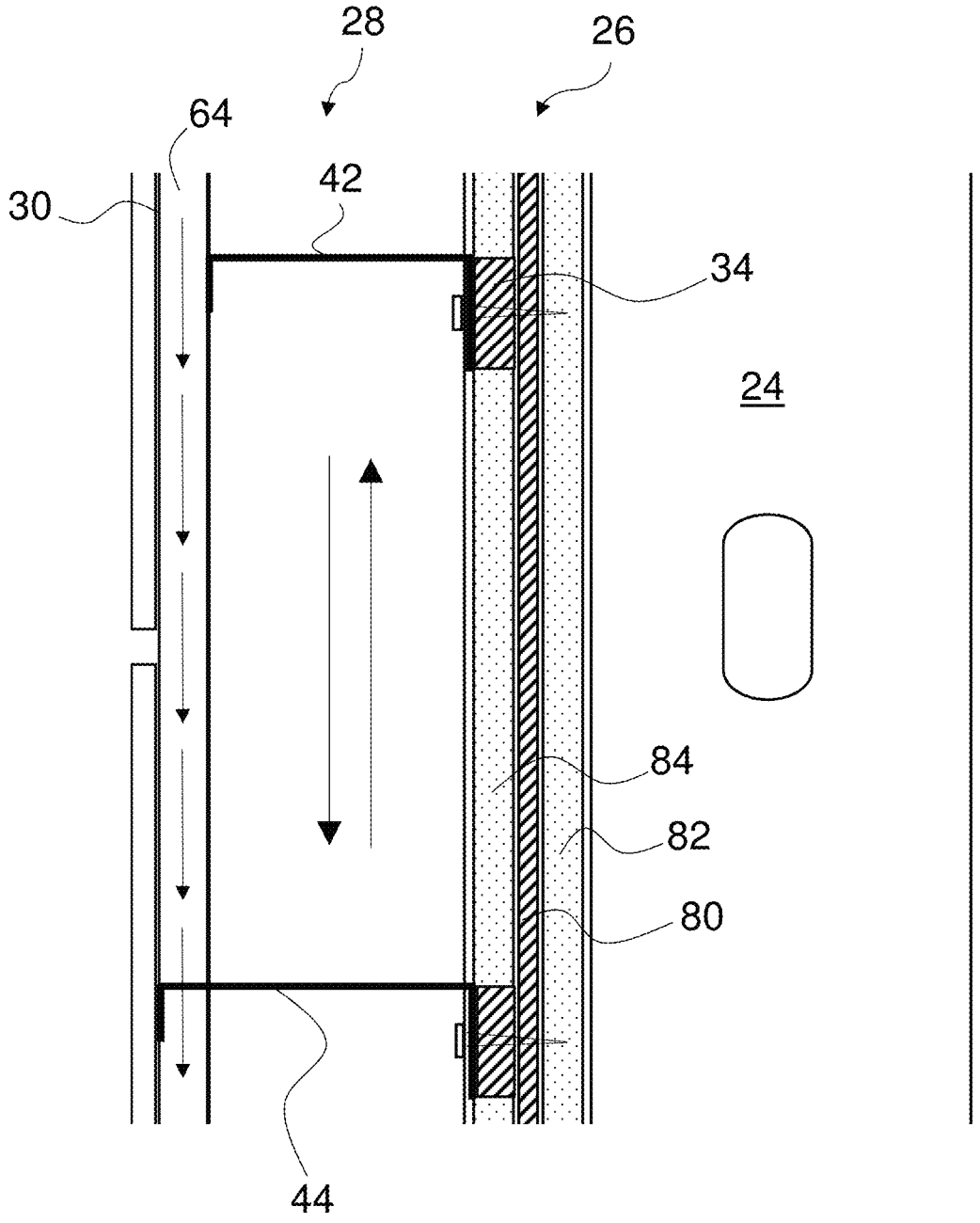
FIG. 14 is a partial vertical sectional view of the thermally separated composite panel assembly of FIGS. 12 and 13.

The embodiment of the thermally separated composite panel assembly 20 shown in FIGS. 12 to 14 has a thermal separation layer 26 which includes a metal sheathing 80, an inner continuous strip 82 and an outer continuous strip 84. The metal sheathing 80 is operably attached to the steel panel 24 with the inner continuous strip 82 and operably attached to the plenum 28 with an outer continuous strip 84. Sealant 86 is included around the periphery of the inner continuous strip 82 and the outer continuous strip 84. Optionally a plurality of spaced apart thermal separation blocks 34 may also be included. The plurality of spaced apart thermal separation blocks 34 may be screwed to the metal sheathing 80. The inner continuous strip 82 and the outer continuous strip 84 each form a continuous perimeter around the perimeter of metal sheathing 80. Typically the metal sheathing is aluminium or galvanized sheet steel. Typically, the inner continuous strip 82 and the outer continuous strip 84 is a high strength open cell polyurethane foam strip that is compatible with silicon. Typically, the sealant 86 is a silicon caulking. The plenum 28 is the same as described above. It will be appreciated by those skilled in the art that by using inner continuous strip 82 to connect the thermal separation layer 26 to the steel panel 24 there are some seismic advantages because the plenum 28 is not directly fastened to the steel panel 24.

It will be appreciated by those skilled in the art that the embodiment of the thermally separated composite panel assembly 20 shown in FIGS. 12 to 14 could be further modified by not including the thermal separation blocks 34. The advantage would be that no metal fasteners would then be used. Further there would be additional seismic benefits as the plenum 28 would be attached to the metal sheathing 80 with outer continuous strip 84.

Figure 15:
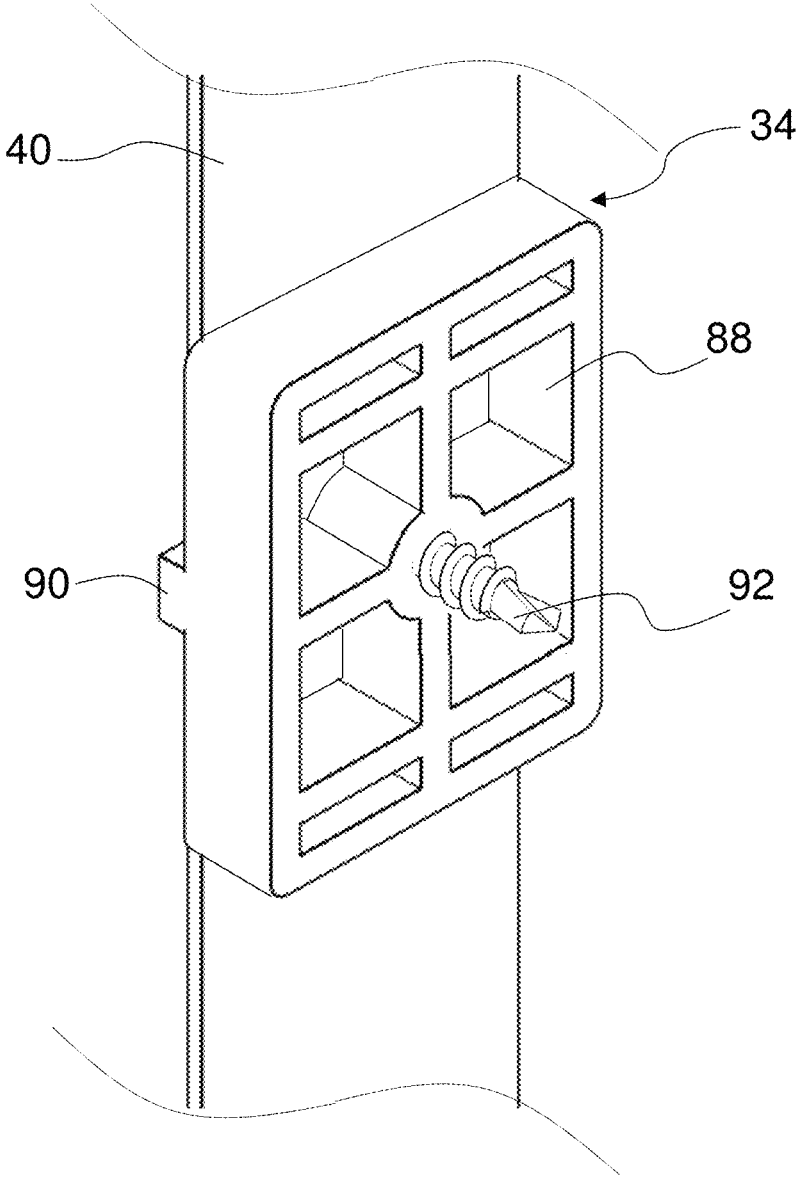
FIG. 15 is a rear perspective view of a thermal separation block of the thermally separated composite panel assembly.
Figure 16:
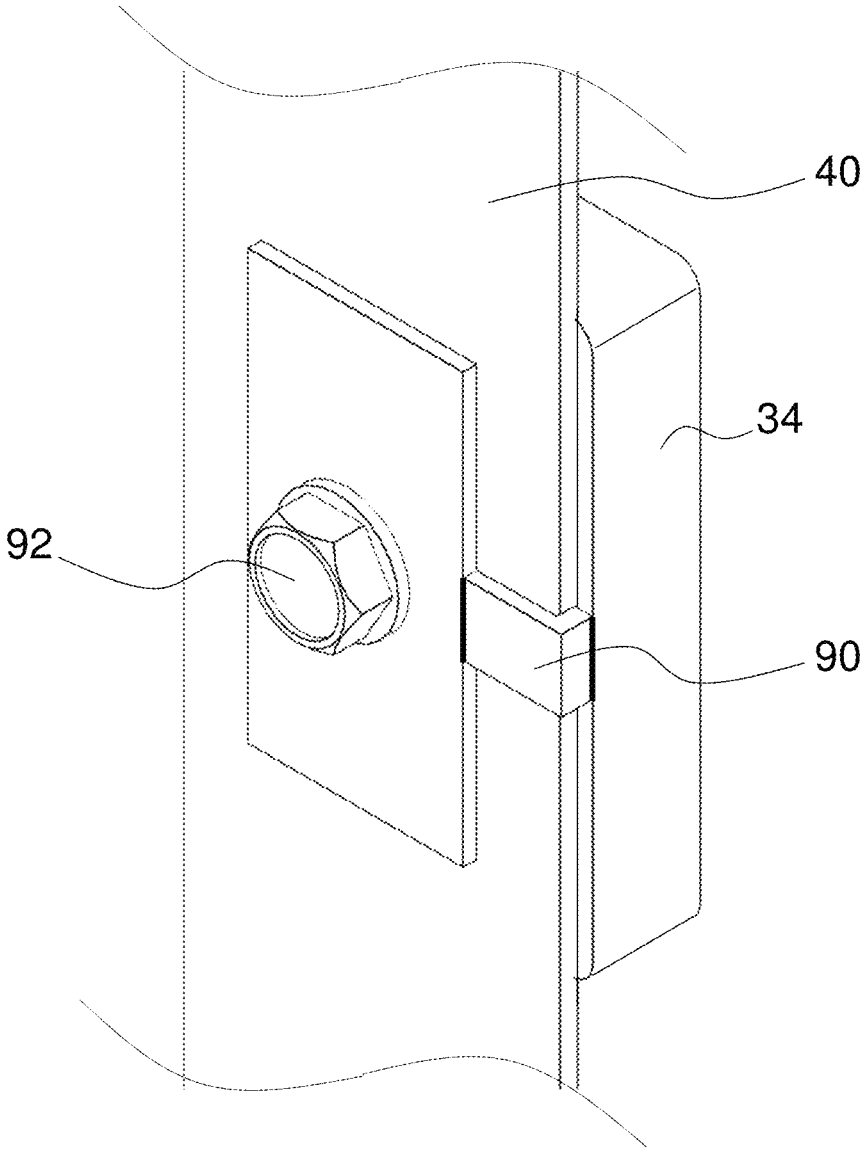
FIG. 16 is a front perspective view of the thermal separation block of FIG. 15.

Referring to FIGS. 15 and 16, the thermal separation blocks is shown generally at 34. The thermal separation blocks 34 has a plurality of holes 88 formed therein. This reduces the contact area for the thermal separation blocks 34 and the cost of the blocks. Typically the thermal separation blocks 34 are made of plastic. The thermal separation blocks 34 has a clip 90 which extends from one side thereof and is used to attach the clip to a perimeter girt 40 or an interior girt 42. This makes it easier to hold the block in place when fasteners 92 are installed. In the embodiments shown herein, the fasteners are screws, however other fasteners may also be used. As shown in FIG. 10 the fastener may connect the perimeter girt 40 through the thermal separation blocks 34, through the sheathing board 32 and through the steel panel 24. Alternatively as shown in FIG. 13 the fastener may connect the perimeter girt 40 through the thermal separation blocks 34 and the metal sheathing 80.

Figure 17A:
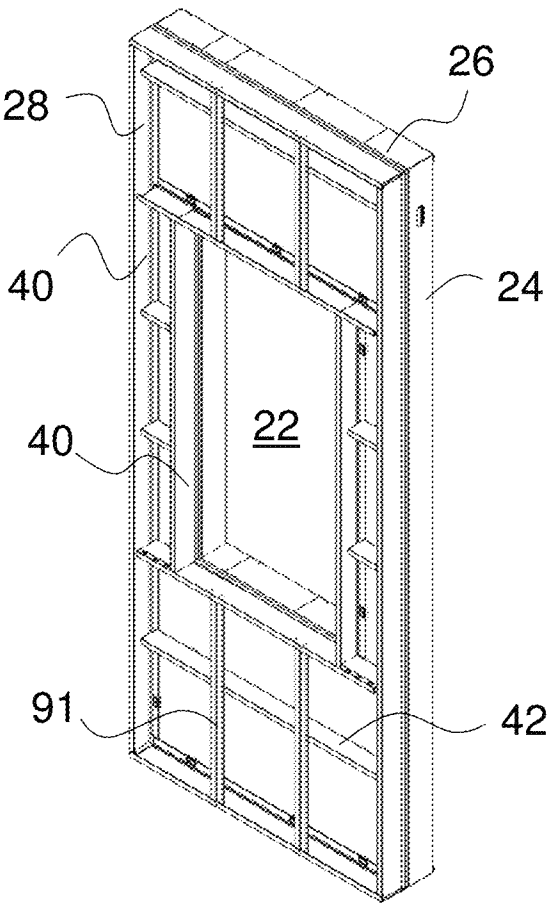
FIG. 17A is a front perspective view of the first stage in constructing a thermally separated composite panel assembly.
Figure 17B:
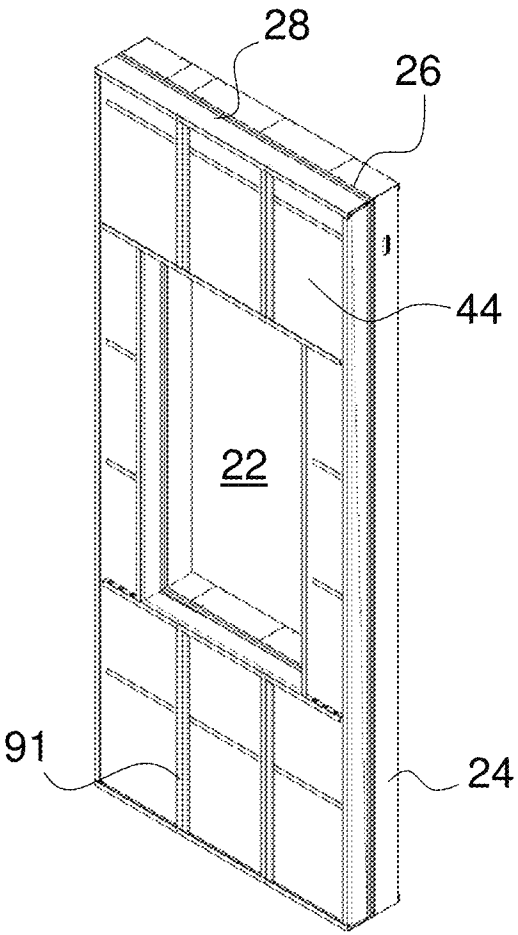
FIG. 17B is a front perspective view of the second stage in constructing a thermally separated composite panel assembly of FIG. 17A and further including the insulation.
Figure 17C:
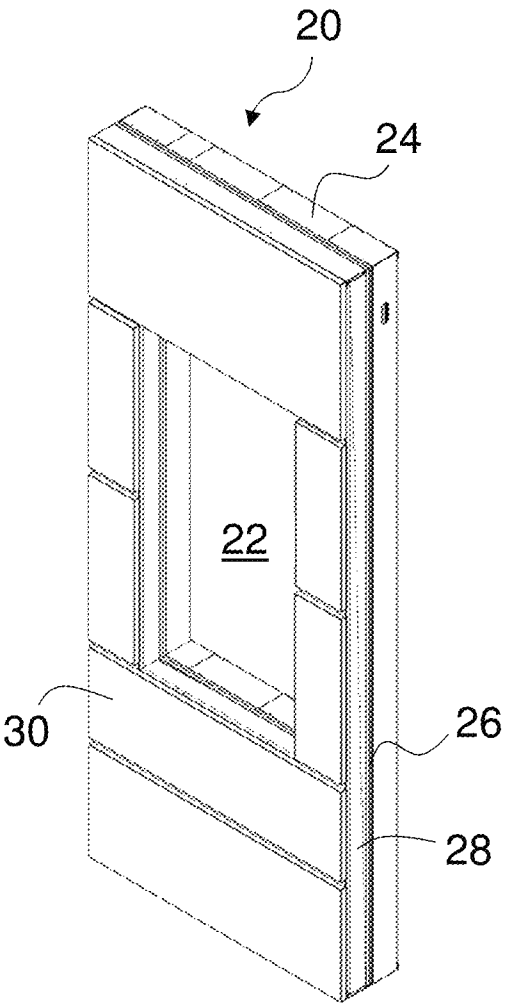
FIG. 17C is a front perspective view of the finished stage in constructing a thermally separated composite panel assembly of FIGS. 17A and 17B and further including the cladding.

It will be appreciated by those skilled in the art that one of the advantages of the thermally separated composite panel assembly 20 is that it may be constructed off site. The steps in constructing panel assembly 20 are shown in FIGS. 17A, 17B and 17C. FIG. 17A shows the first stage in constructing a thermally separated composite panel wherein the thermal separation layer 26 is operably attached to the steel panel 24. In addition, a plurality of perimeter girts 40 and a plurality of the interior girts 42 of the plenum 28 are operably attached to the thermal separation layer. Perimeter girts 40 are operably attached around the perimeter in registration with the perimeter of the steel panel 24. In addition, the perimeter girts 40 are operably attached around the window 22. Interior girts 42 are attached between the perimeter girts 40. As shown in FIG. 17B the insulation 44 is then added. A plurality of hat channels 91 are then positioned between the girts 40 and 42 to hold the insulation 44 in place. Thereafter the cladding is operably attached as shown in FIG. 17C.

Figure 18:
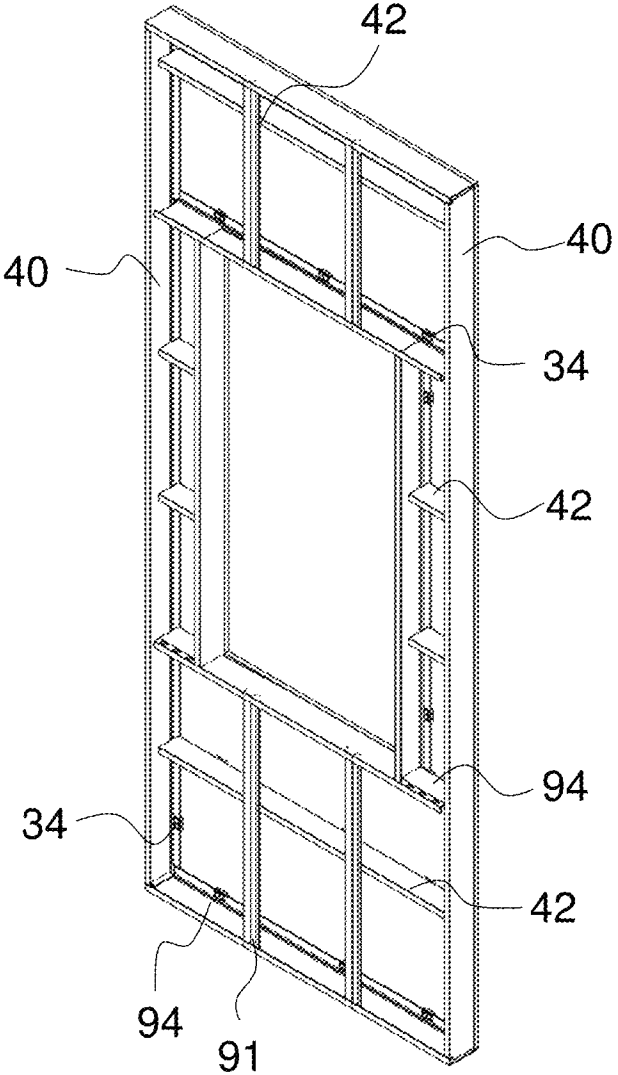
FIG. 18 is a rear perspective view showing the plenum and part of thermally separated composite panel assembly.
Figure 20:
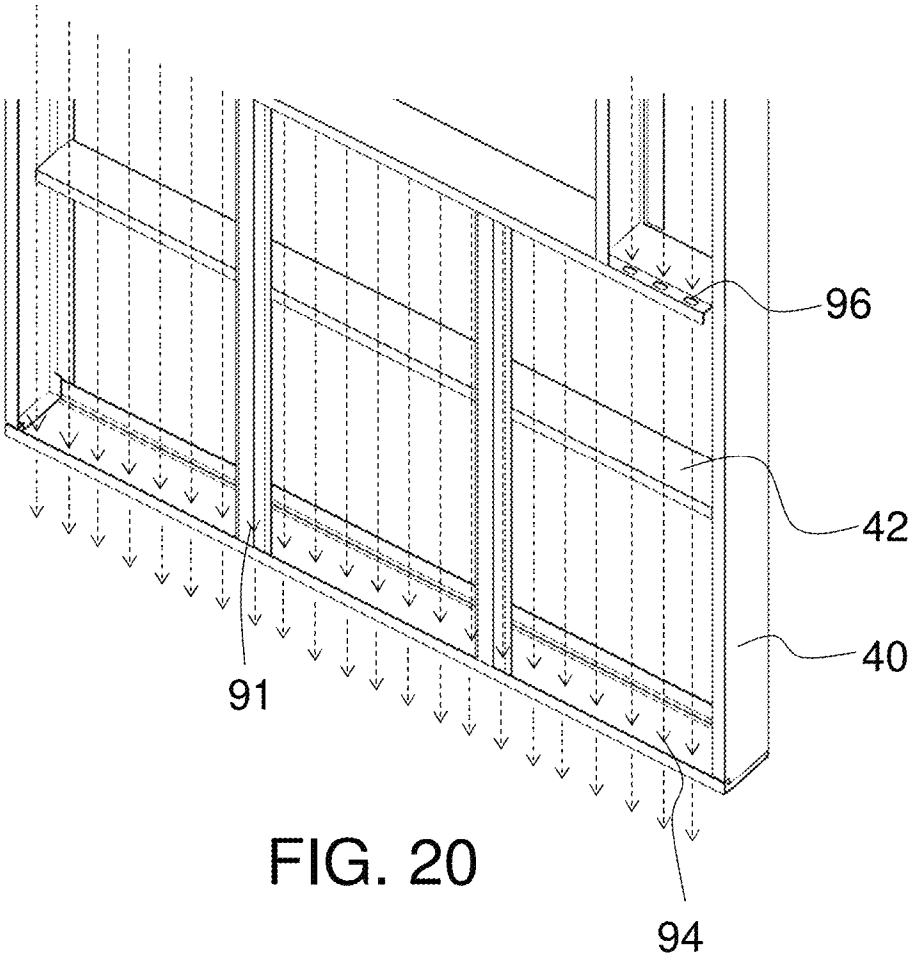
FIG. 20 is a rear perspective view showing the drainage of an embodiment of thermally separated composite panel assembly.
Figure 19:
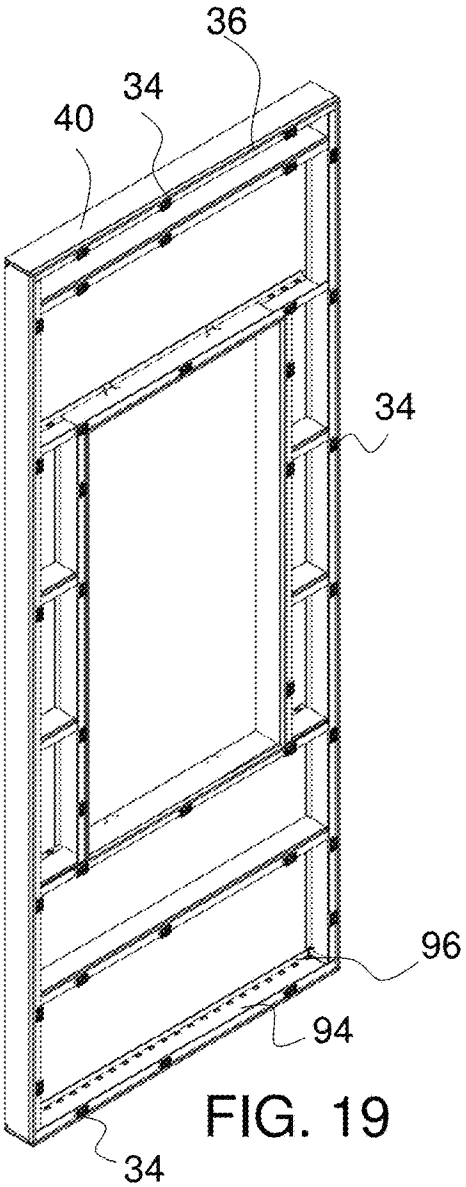
FIG. 19 is a front perspective view showing the plenum and part of thermally separated composite panel assembly of FIG. 18.
Figure 21:
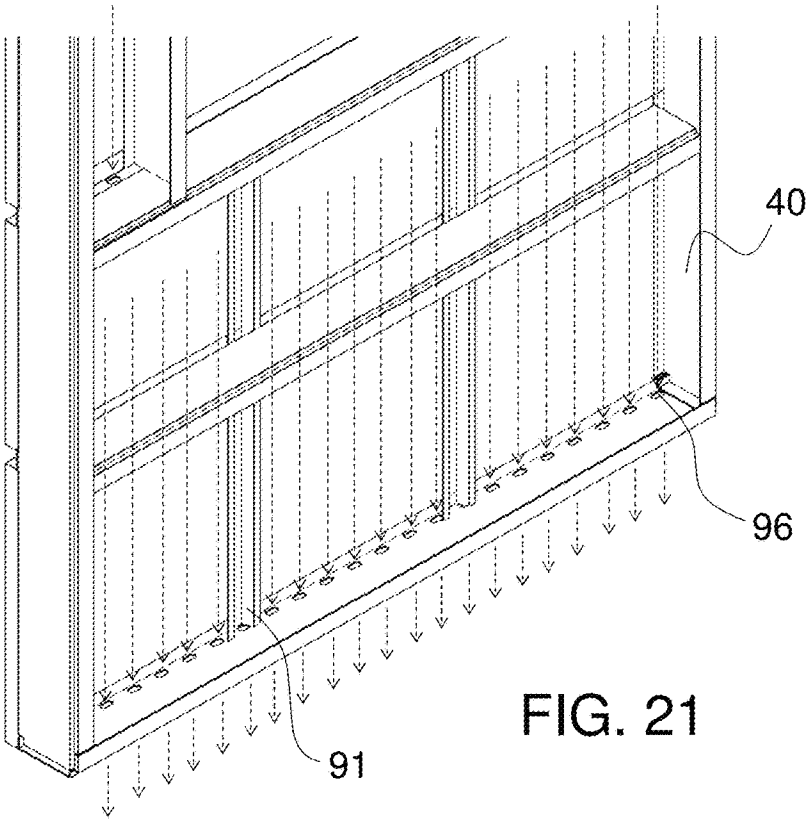
FIG. 21 is a front perspective view showing the drainage of an embodiment of thermally separated composite panel assembly of FIG. 20.

In use the thermal separation blocks 34 are spaced apart around the plenum as can be seen in FIGS. 17A, 18 and 19. This allows a worker to place all of the thermal separation blocks 34 onto an assembled plenum frame. With the assembled plenum frame having all its thermal separation blocks 34 in place, the plenum frame can be placed on top of the thermal separation layer 26 and then fastened thereto.

Referring to FIGS. 18 to 21, some of the perimeter girts 40 are draining perimeter girts 94. The draining perimeter girts 94 are provided with a plurality of drainage holes 96. The plurality of drainage holes 96 allow for air and moisture movement. The drainage holes 96 are formed proximate to the perimeter girt outer face and are in the air cavity 64.

The steel panel 24 is a uniframe. Similarly, all members of the plenum 28 are fixed together to form a rigid structural frame assembly. The girts 40, 42 in the plenum 28 are arranged and fastened to stiffen each other, the members are much stiffer than in the prior art, so less connectors are required, therefor contact area and thermal conductance is reduced over the prior art.

Referring to FIGS. 22 to 30, the thermally separated composite panel assembly may be configured to be used as a load bearing thermally separated composite panel assembly as shown at 100. When the thermally separated composite panel assembly is a load bearing panel assembly the perimeter vertical framing members 102 act as vertical load bearing columns. The perimeter vertical framing members 102 may be made of hot rolled steel.

Figure 22:
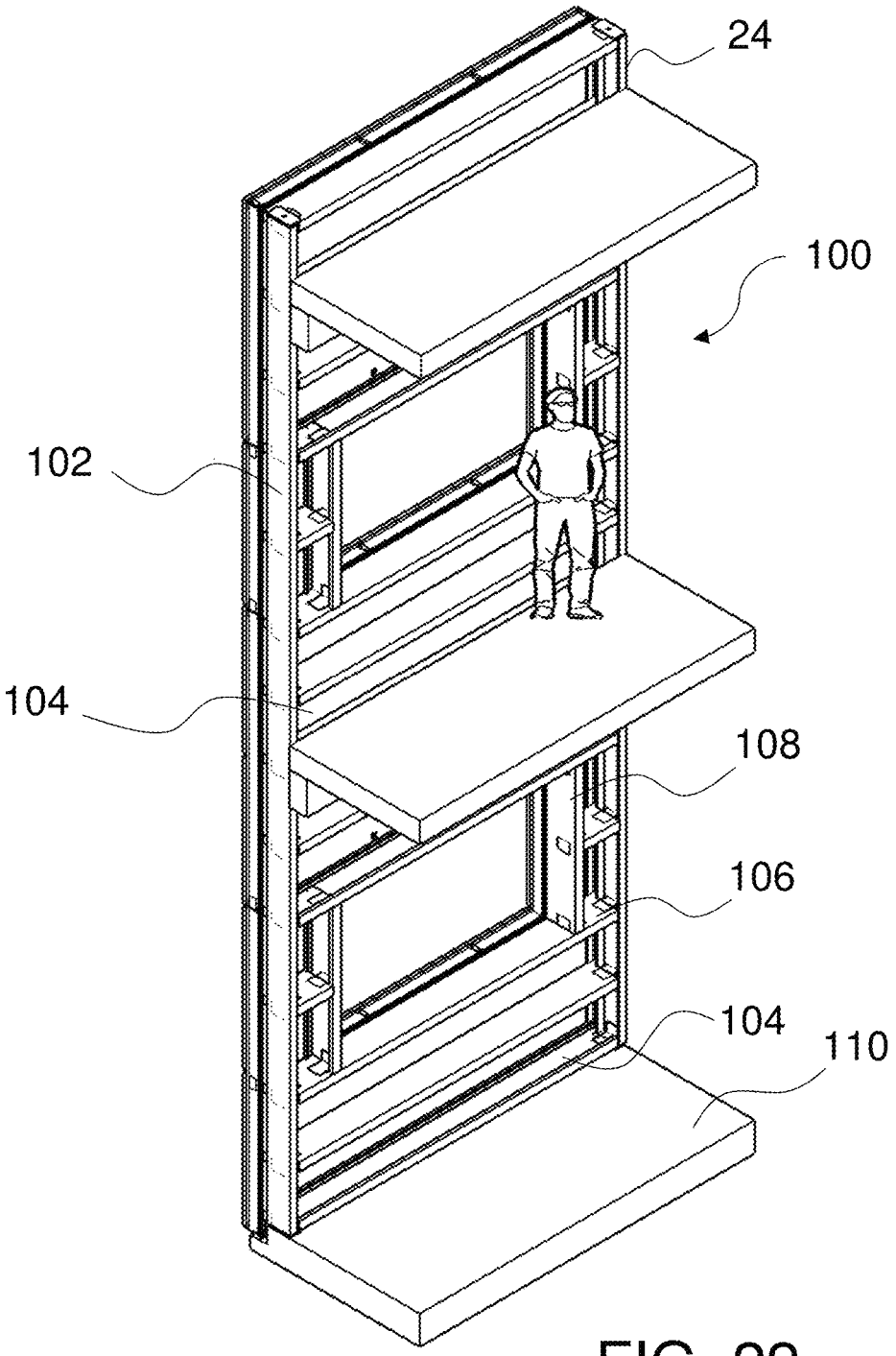
FIG. 22 is a perspective view of a plurality of load bearing thermally separated composite panel assembly, as viewed from the inside, and showing the floor slabs.
Figure 23:
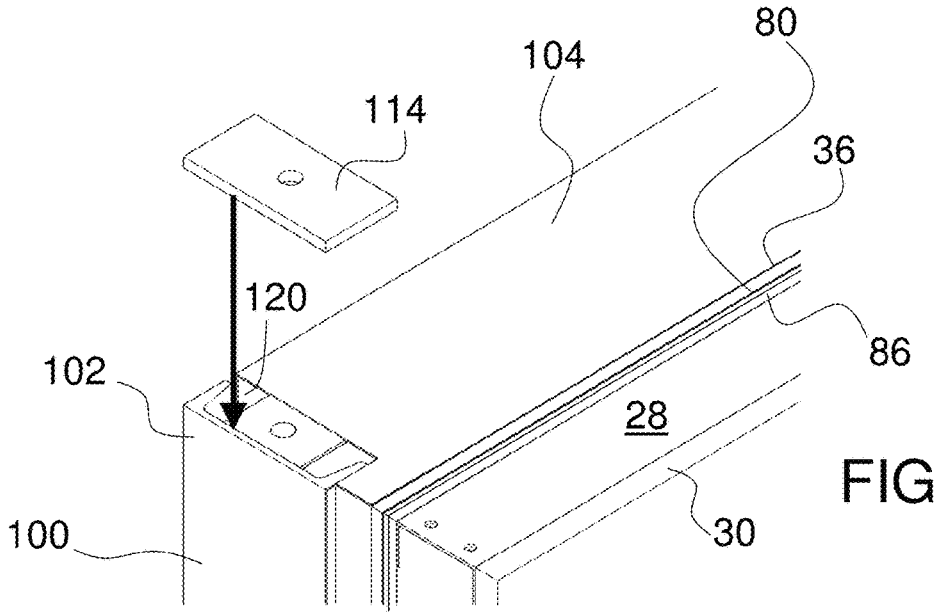
FIG. 23 is an enlarged perspective view of a top edge portion of a load bearing thermally separated composite panel assembly as viewed from the inside.
Figure 24:
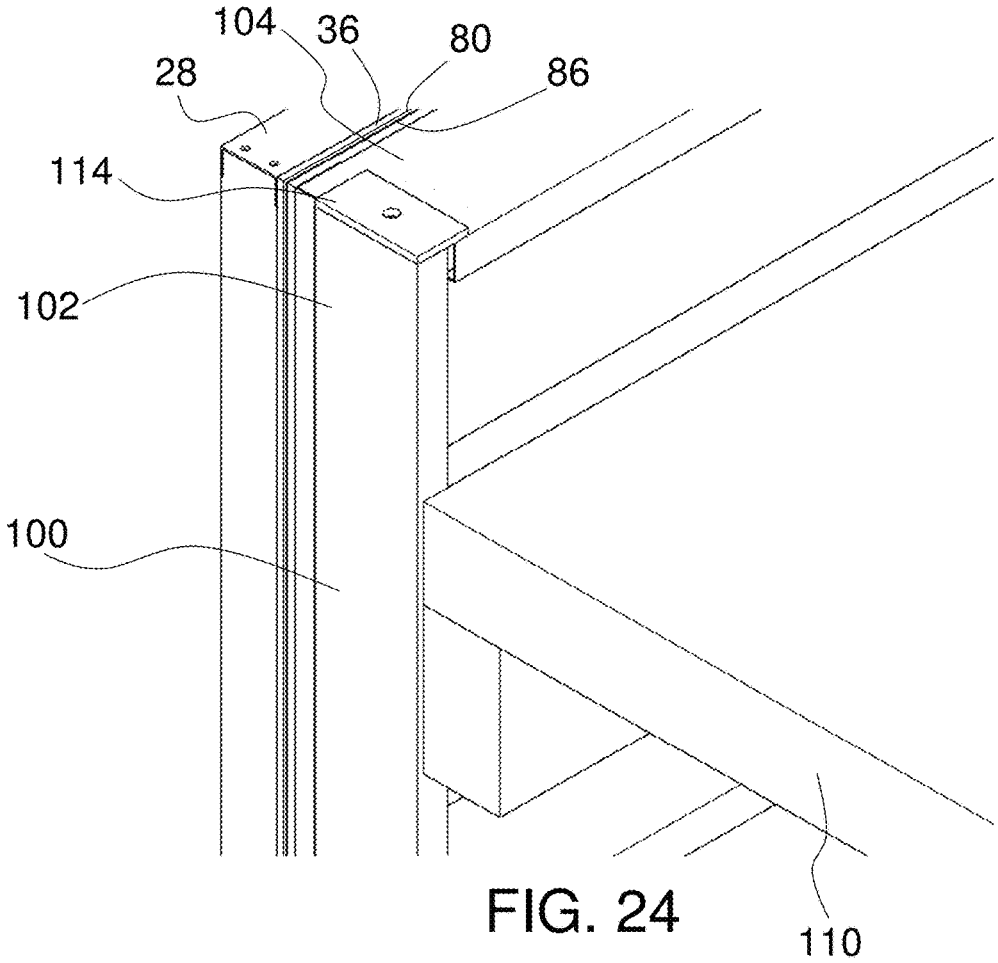
FIG. 24 is a partially blown apart enlarged perspective view of a top edge portion of a load bearing thermally separated composite panel assembly similar to that shown in FIG. 23 but as viewed from the outside.

It will be appreciated by those skilled in the art that the thermally separated composite panel assembly can be sized as needed. For example it may essentially be one storey or less as shown in FIGS. 5 and 6 or it may be multi-storied as shown in FIGS. 8 and 22.

The steel panel 24 includes two spaced apart perimeter vertical framing members 102 and two spaced apart perimeter horizontal framing members 104. The steel panel 24 may include additional interior horizontal panel members 106 or additional vertical panel members 108. The vertical and horizontal framing members may be made of cold rolled steel or hot rolled steel. In one example the vertical framing members 102 is made of cold rolled steel and the horizontal framing members 104 are made from cold rolled steel. Similarly the interior horizontal members 106 and the additional vertical members 108 are made from cold rolled steel. Interior horizontal members 106 and vertical members 108 are for framing windows and doors.

Where the thermally separated composite panel assembly is used as a load bearing thermally separated composite panel assembly, floor slabs 110 may be connected to the steel panel 24.

Figure 27:
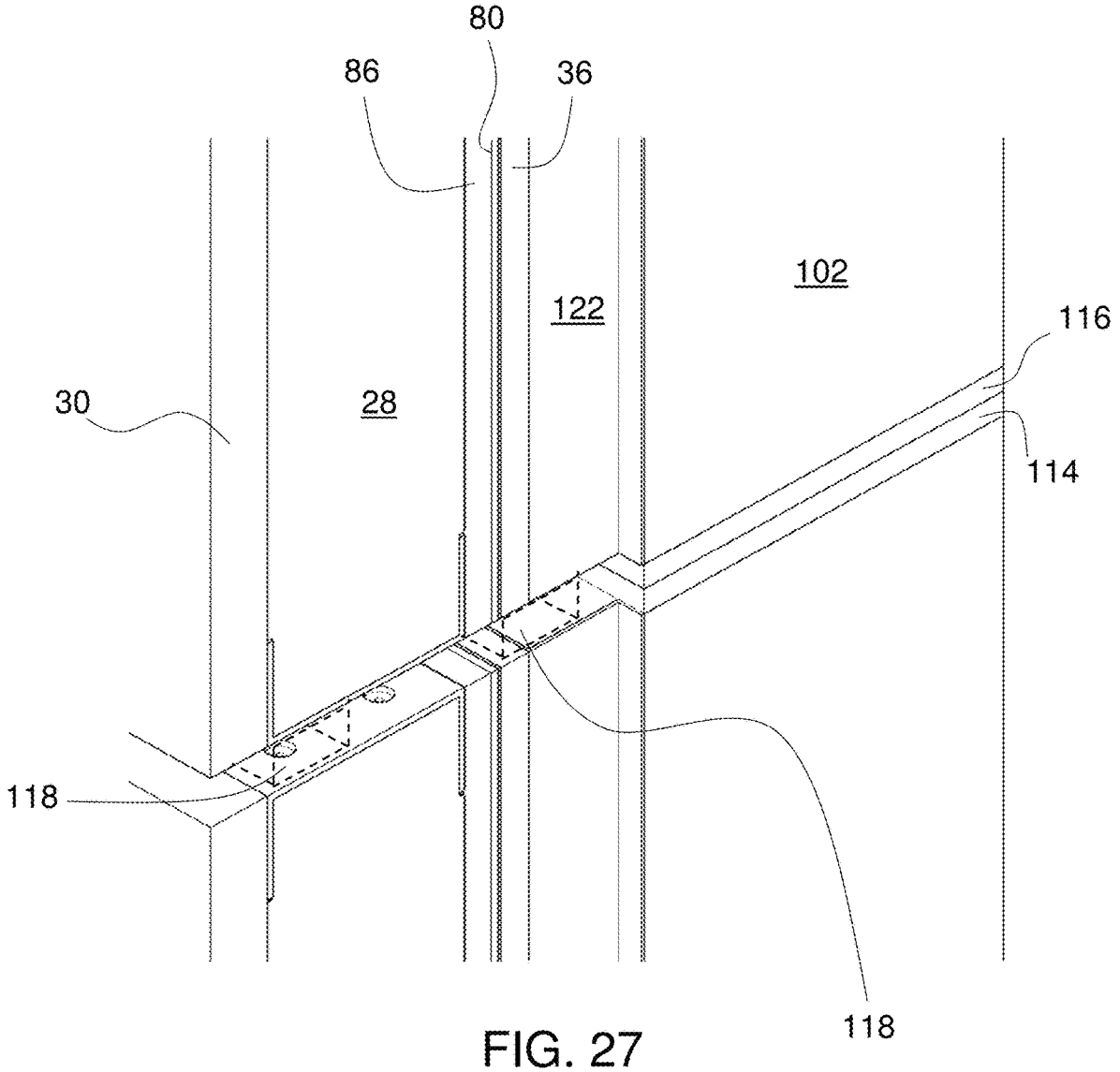
FIG. 27 is an enlarged perspective view of a pair of vertically adjacent load bearing thermally separated composite panel assemblies of FIG. 26.
Figure 30:
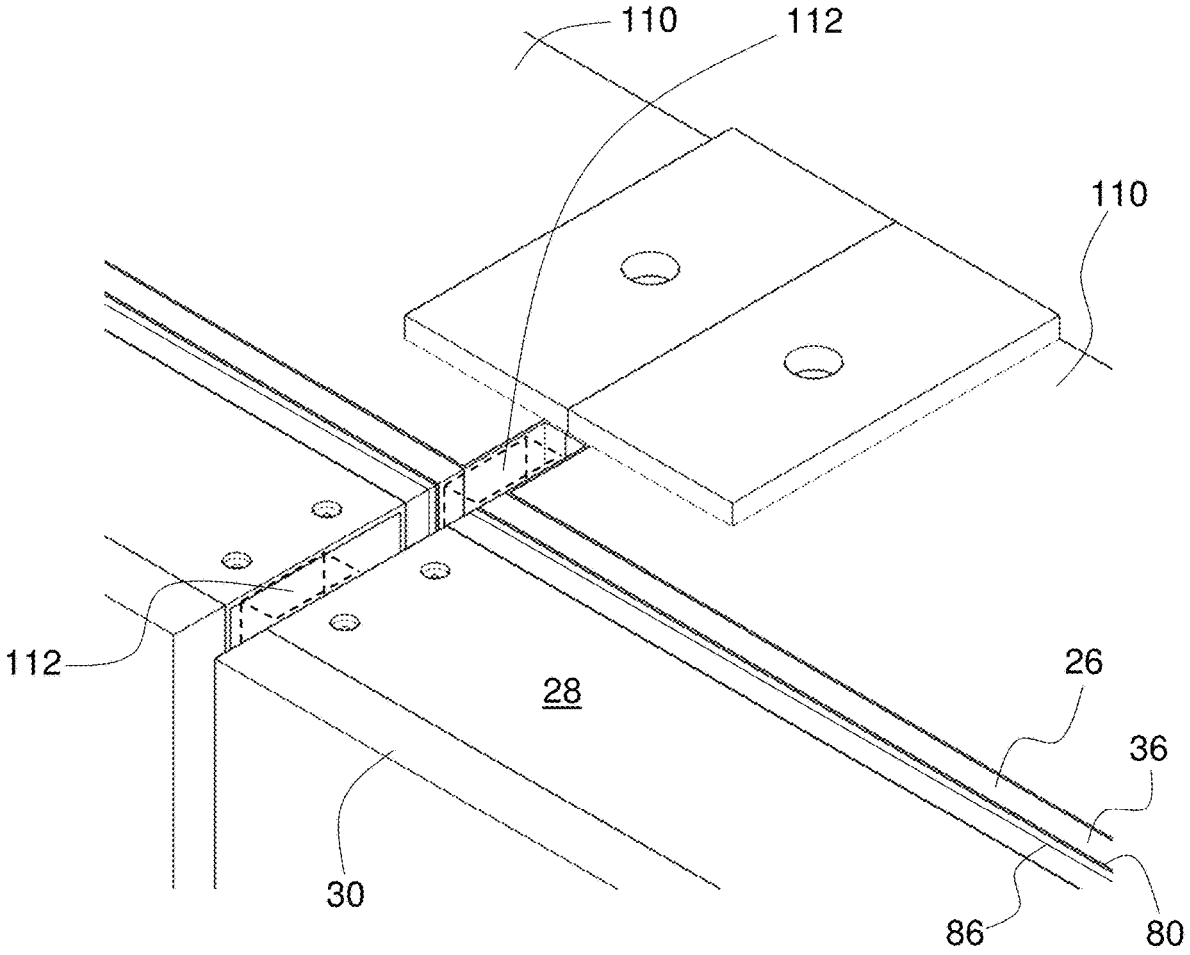
FIG. 30 is an enlarged top perspective view of horizontally adjacent load bearing thermally separated composite panel assemblies.
Figure 31:
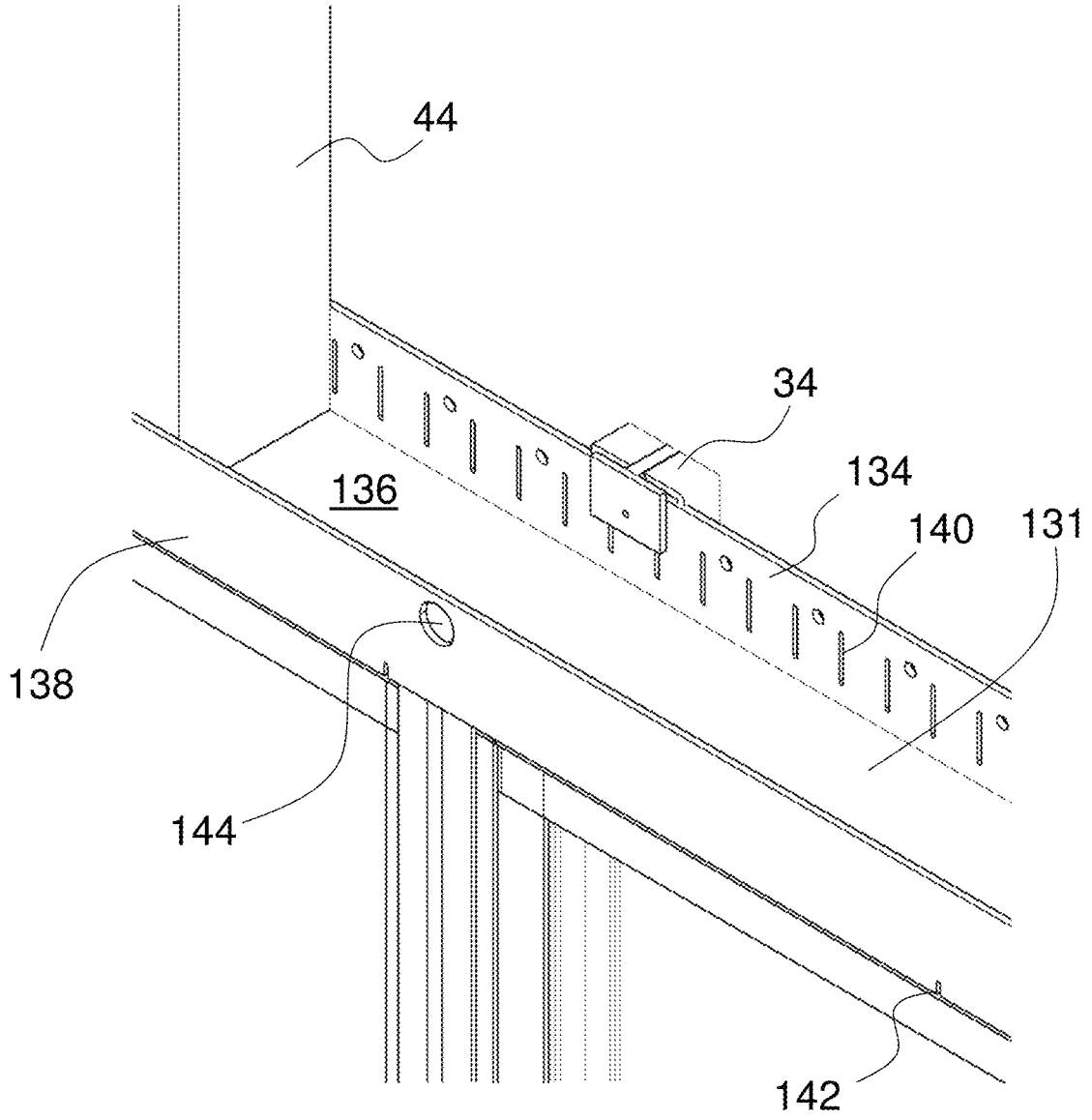
FIG. 31 is an enlarged perspective view of a portion of the steel panel that is above a window or door of a thermally separated composite panel assembly.
Figure 32:
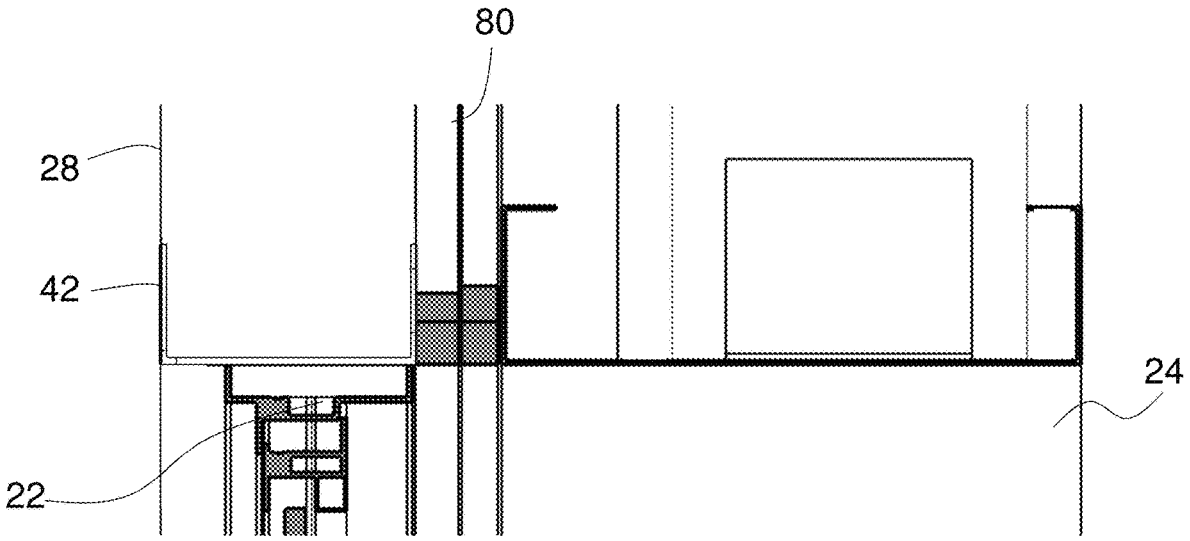
FIG. 32 is an enlarged sectional view of a portion of a thermally separated composite panel assembly around a window or door.

The load bearing thermally separated composite panel assembly 100 is configured so that when vertically adjacent panels 100 are in position a portion of the panels are spaced apart to receive vertical seals 112 therebetween as seen in FIG. 30. The panel assemblies are provided with a top plate 114 and a bottom plate 116 as seen in FIG. 27 to provide space for horizontal seals 118.

The steel panel 24 of the load bearing thermally separated composite panel assembly 100 includes a horizontal framing member 104 connected to a vertical framing members 102. The horizontal framing member has a portion cut out 120 to receive the vertical framing member 102. A top plate 114 is attached to the horizontal framing members 104 such that the vertical load passes through the top plate 114 into the vertical framing members 102. Similarly a bottom plate 116 is attached to the horizontal framing members 104 such that the vertical load passes through the bottom plate 116 into the vertical framing members 102.

Figure 25:
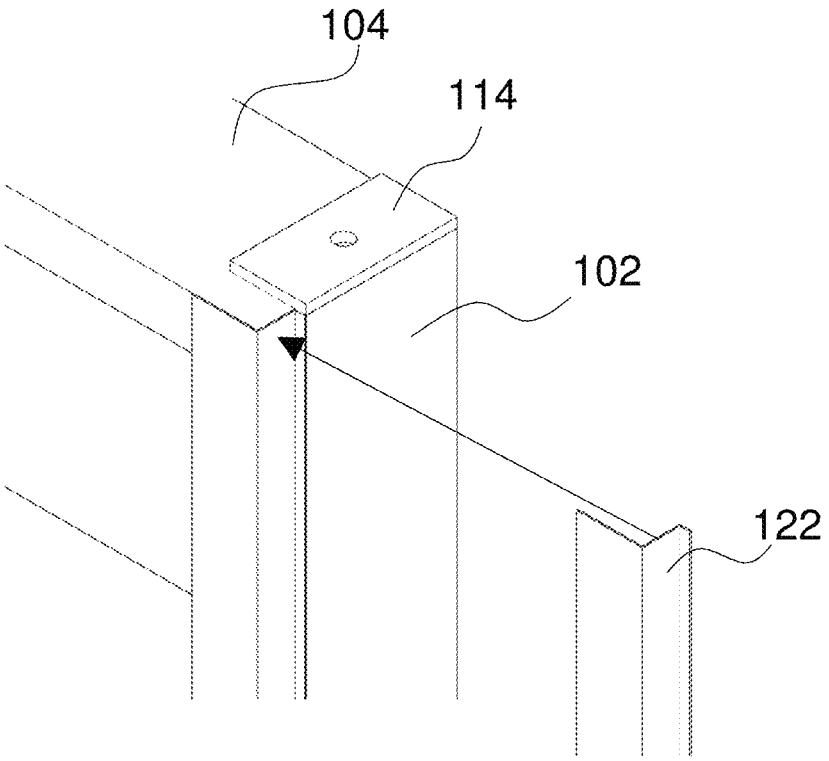
FIG. 25 is a partially blown apart enlarged view of a top edge of the steel panel of the load bearing thermally separated composite panel assembly.
Figure 26:
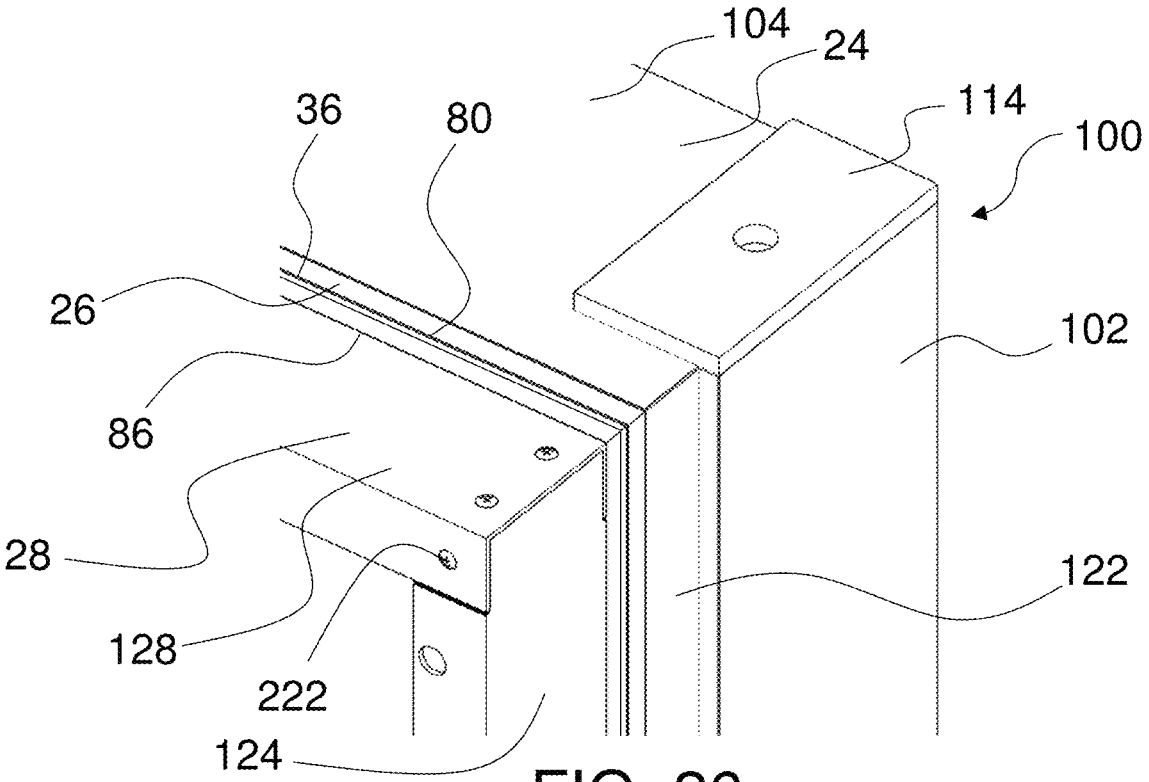
FIG. 26 is an enlarged view of a top edge of a load bearing thermally separated composite panel assembly including the steel panel of FIG. 25.

In the load bearing thermally separated composite panel assembly 100 the cladding 30, the plenum 28 and the thermal separation layer 26 are slightly narrower than the widest portion of the steel panel 24 which allows for vertical seals 112 to be positioned between vertically adjacent panel assemblies 100. An elongate closure member 122 is attached to the vertical framing members 102 and the horizontal framing members 104 as shown in FIGS. 25 and 26. The elongate closure member 122 is a generally L-shaped member with a lip and it is arranged such that a portion is spaced in from the side.

In the embodiment shown in FIGS. 26 and 30 the thermal separation layer 26 is similar to that shown in FIGS. 12 and 13 and includes a metal sheathing 80, between a sealant 86 and a weather strip 36.

Figure 28:
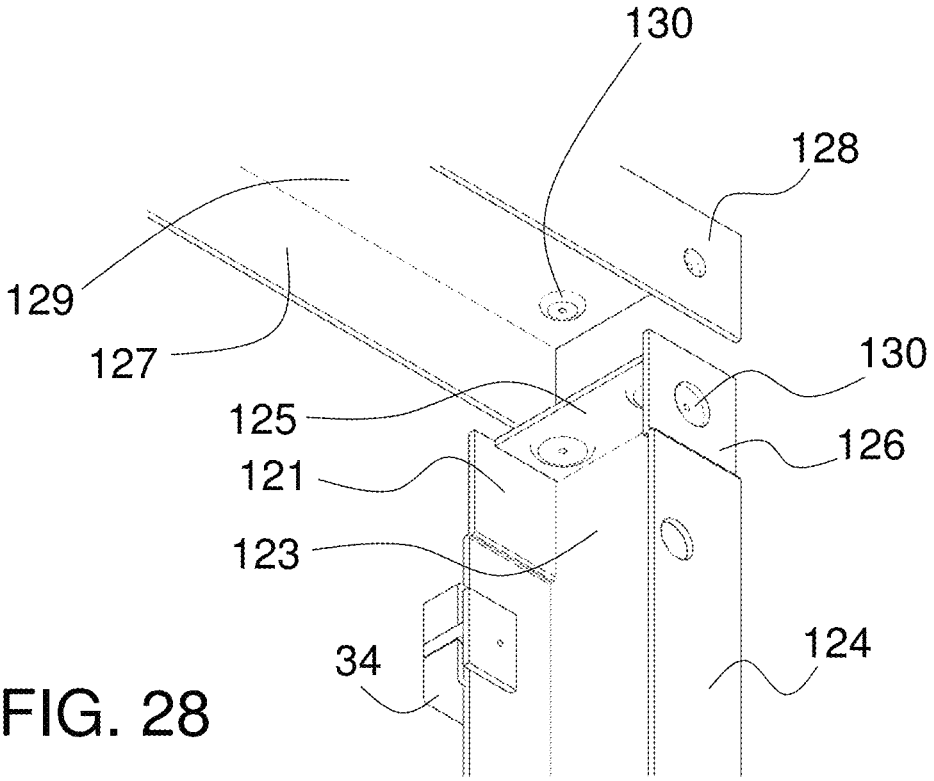
FIG. 28 is a blown apart enlarged view of a top edge of a steel panel of the load bearing thermally separated composite panel assembly as viewed from below.
Figure 29:
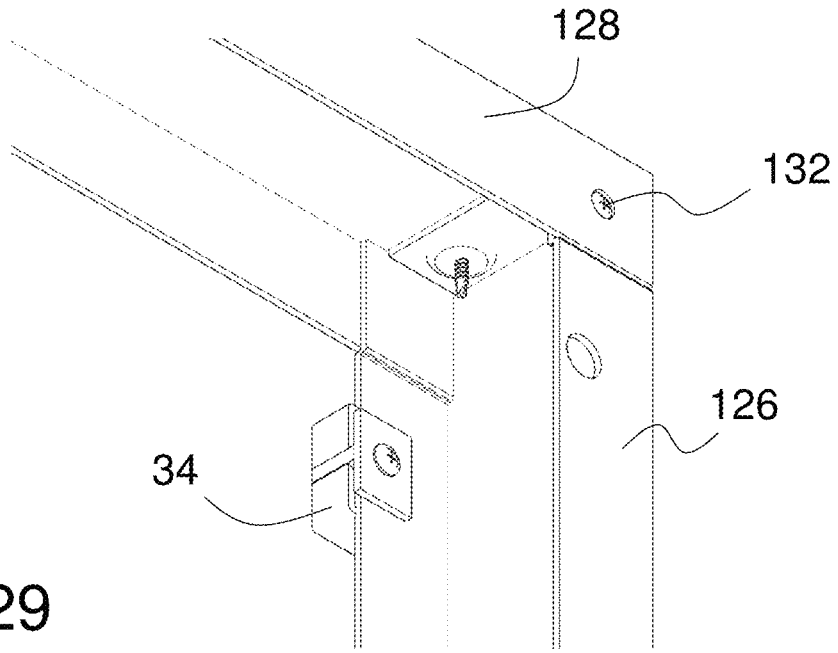
FIG. 29 is an enlarged view of a top edge of the assembled steel panel assembly of the load bearing thermally separated composite panel of FIG. 28 as viewed from below.

In one embodiment the plenum 28 is constructed such that screws and the members present a smooth line. Referring to FIGS. 28 and 29 the vertical plenum member 124 has a step 126 formed therein at the top and the bottom thereof for receiving the horizontal plenum member 128. Thereby the outside of the vertical plenum member 124 is generally in line with horizontal member 128. Screw holes 130 are dimpled so the screw heads are flush when assembled.

Figure 37A:
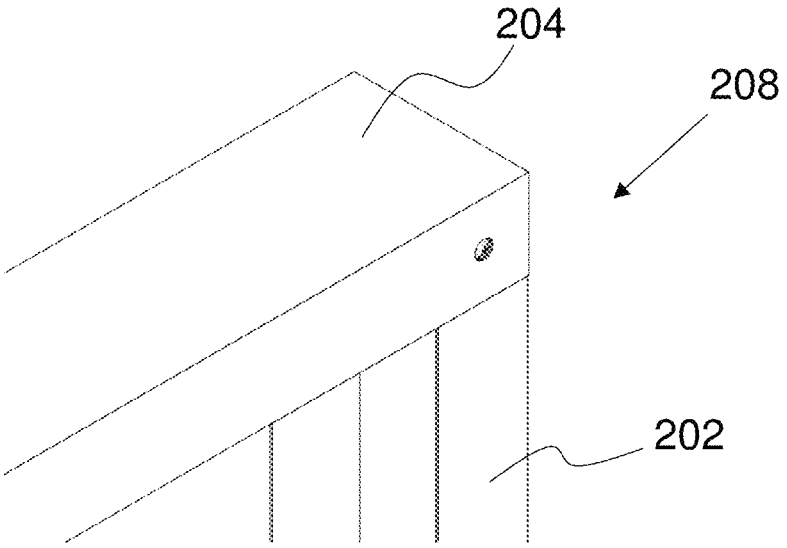
FIG. 37A (PRIOR ART)
FIG. 37A is a perspective view of an alternate prior art steel frame connection.
Figure 37B:
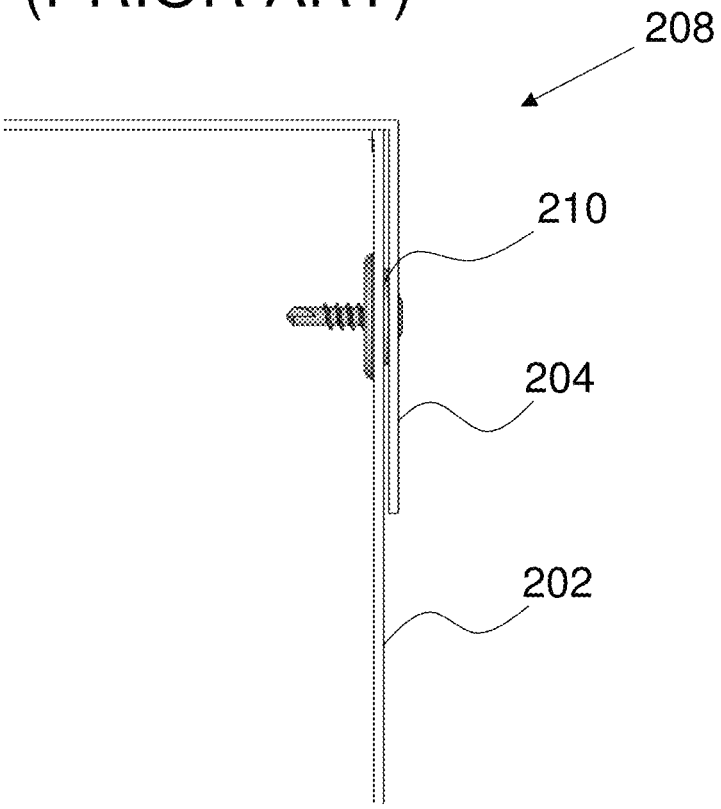
FIG. 37B (PRIOR ART)
FIG. 37B is a sectional view of the connection of FIG. 37A.
Figure 38A:
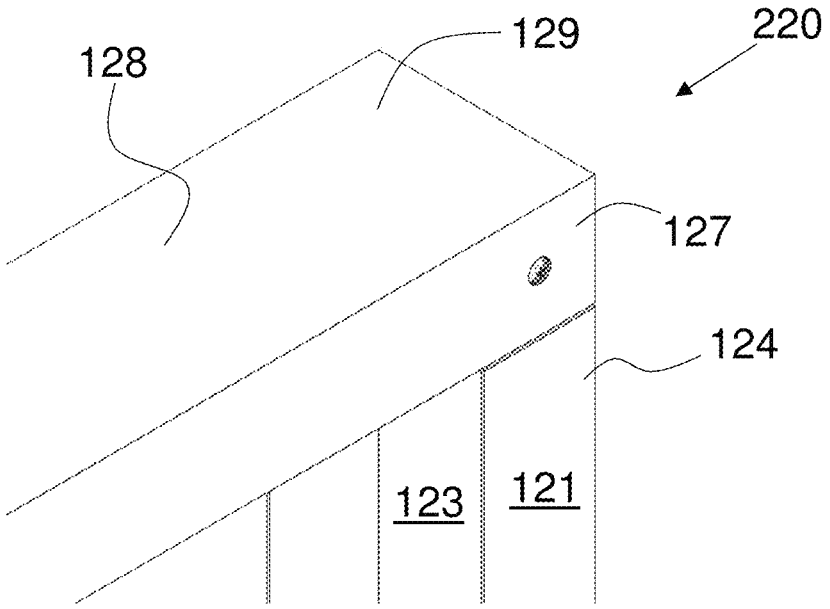
FIG. 38A is an enlarged perspective view of a steel frame connection, similar to that shown in FIG. 26.
Figure 38B:
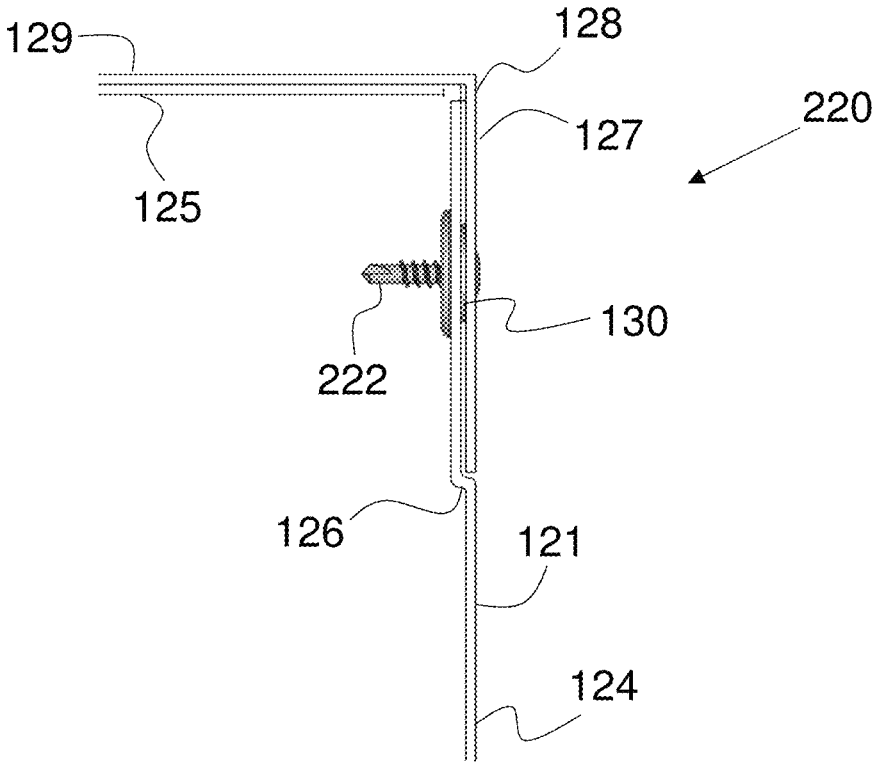
FIG. 38B is an enlarged sectional view of the connection of FIG. 38A.

The plenum 28 shown herein is a clear improvement over the prior art, examples of which are shown in FIGS. 36A, 36B, 37A and 37B. The prior art light steel framing member or plenum 200 shown in FIGS. 36A and 36B includes a vertical member 202 and a horizontal member 204 held together with a screw 206. The prior art light steel framing member or plenum 208 shown in FIGS. 37A and 37B is similar to that shown in FIGS. 36A and 37B but it includes a dimpled screw hole 210. In both these examples the horizontal member 204 extends downwardly over the vertical member 202. As well the screw 206 extends outwardly from the horizontal member 204 where it connects with the vertical member 202 creating a bump. Thus, the finished prior art light steel framing member or plenum does not provide a smooth surface resulting in bumps translating through the finished drywall. The bumps were the result of the drywall having to conform to changing surface levels at the joints combined with the head of the fasteners sticking out.

In contrast to the prior art shown herein the light steel framing member or plenum shown herein overcomes these issues. The light steel framing member or plenum 220, 28 shown in FIGS. 38A and 38B and FIG. 26, 28, 29 respectively provide a flat surface for attaching drywall or other cladding thereto. The light steel framing member or plenum 220, 28 includes a vertical plenum member 124 and a horizontal plenum member 128. The horizontal member 128 includes a pair of horizontal plenum flanges 127 and a horizontal plenum web 129 therebetween. The vertical plenum member 124 has a pair of vertical plenum flanges 121 and a vertical plenum web 123 therebetween and at each end thereof there is a web lip 125 extending inwardly from the vertical plenum web 123. Each vertical plenum flange 121 of the vertical plenum member 124 has a step 126 formed therein at the top and the bottom thereof for receiving the horizontal flange 127 of horizontal plenum member 128. Thereby the outside of the vertical plenum flange 121 of the vertical plenum member 124 is generally in line with horizontal plenum flange 127 of horizontal member 128. Screw holes 130 are dimpled (as best seen in FIGS. 28 and 29) are formed in the horizontal plenum flanges 127 of the horizontal plenum member 128 so that the screw heads 222 are flush when assembled. As seen in FIGS. 26, 28 and 29 the horizontal flange 125 may include dimpled screw holes for receiving screws 222 that connect the horizontal flange 125 to the vertical web lip 125.

The light steel framing plenum 20, 28 includes a horizontal plenum member 128, a vertical plenum member 124 and plurality of screws 222. The horizontal plenum member 128 includes a pair of horizontal plenum flanges 127 and horizontal plenum web 129. The horizontal plenum flanges 127 have dimpled screw holes 130 formed therein. The vertical plenum member 124 is attached to the horizontal plenum member 128. The vertical plenum 124 member has a pair of vertical plenum flanges 121 and a vertical plenum web 123 therebetween. Each vertical plenum flange 121 has a step 126 formed therein for receiving the horizontal flange 127 from the attached horizontal plenum member 128. A plurality of screws 222 are provided to attach the horizontal plenum member 128 to the vertical plenum member 124. The lights steel framing plenum provides a generally flat surface for attachment thereto.

The vertical member 124 may further include a pair vertical web lips 125 extending inwardly from the vertical web 123 at each end thereof. Each horizontal web 129 may include at least one dimpled screw hole 130 formed therein. The light steel framing plenum may further include screws 222 for attaching the pair of vertical web lips 125 of the vertical plenum member to the horizontal web 129.

Figure 33:
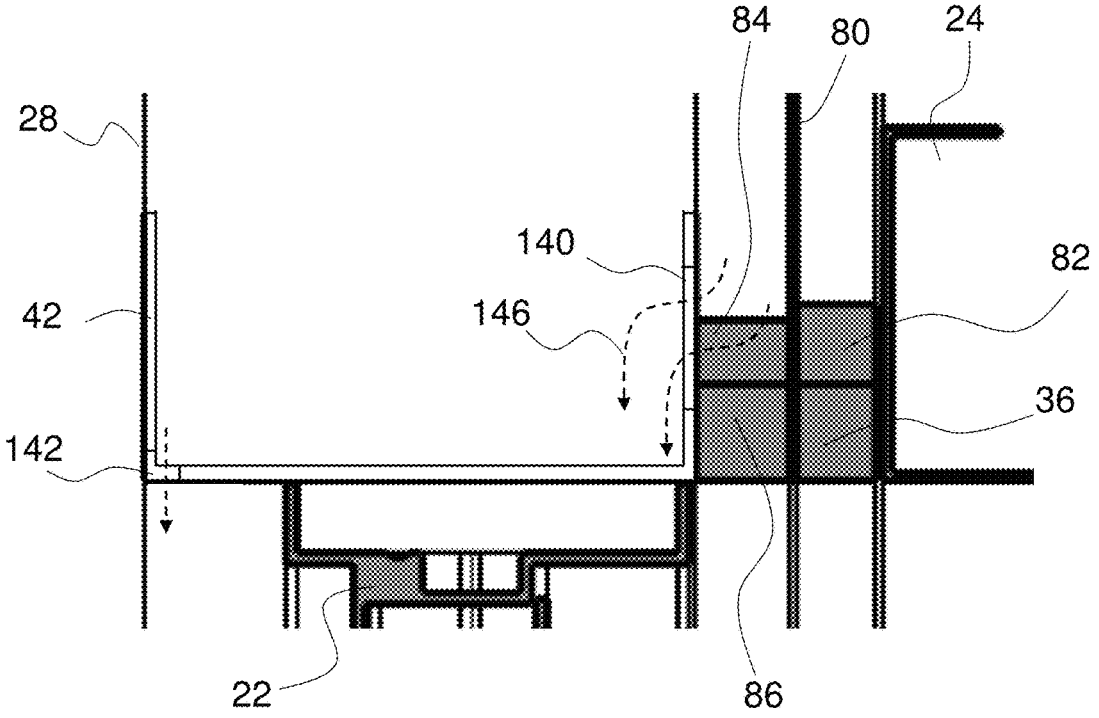
FIG. 33 is a close up of the portion of a thermally separated composite panel assembly around a window or door shown in FIG. 32 and showing the drainage.

Interior girts 42 of the plenum 28 that are for use above a window 22 or a door are referred to herein as framing girts 131 and are provided with a drainage system. Specifically, the horizontal channel member 132 is a generally C-shaped with an inner flange 134, a web 136 and an outer flange 138. The inner flange 136 has a plurality of spaced apart inner slots 140. The outer flange 138 has plurality of outer slits 142. The outer flange 138 also has a plurality of spaced apart holes 144 for receiving a drill bit used to attach a thermal separation blocks 34 to the inner flange 136. Referring to FIG. 33 the drainage path is shown in dotted lines at 146.

Figure 34:
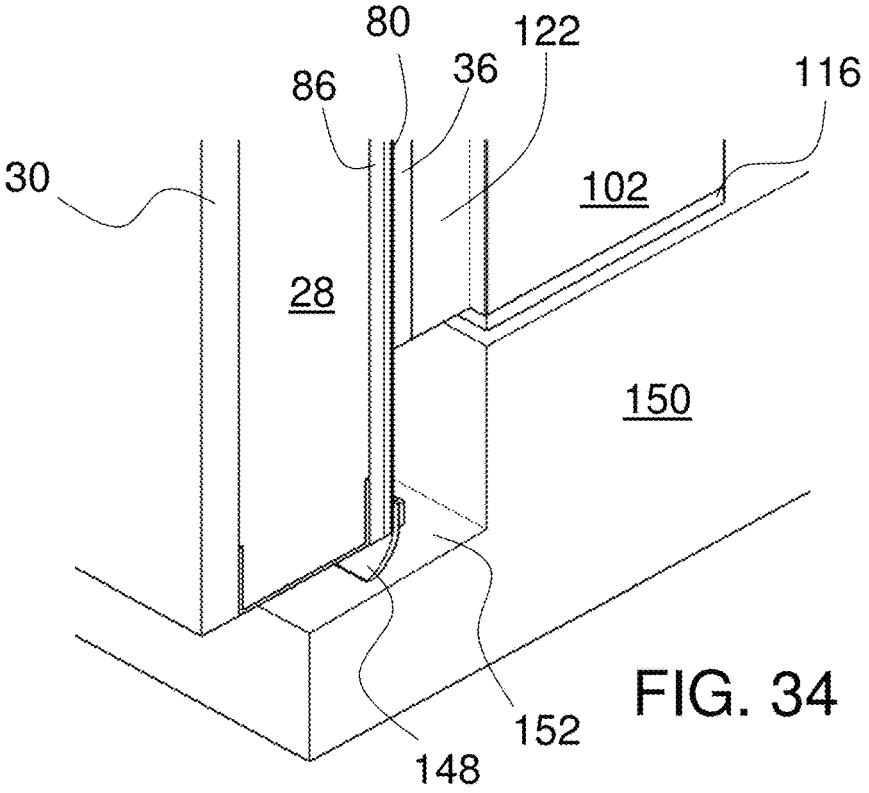
FIG. 34 is a perspective view of a thermally separated composite panel assembly at the ground level.
Figure 35:
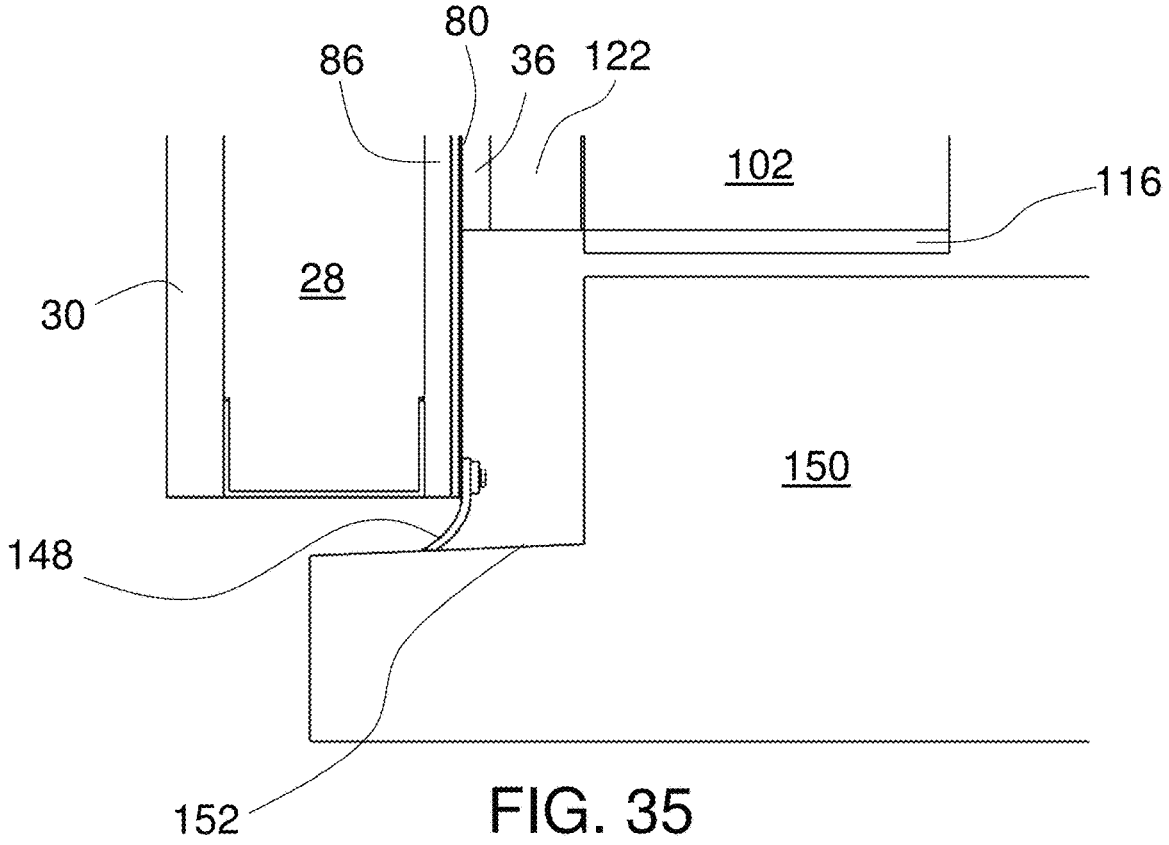
FIG. 35 is a side view of the thermally separated composite panel assembly at the ground level of FIG. 34.
Figure 36A:
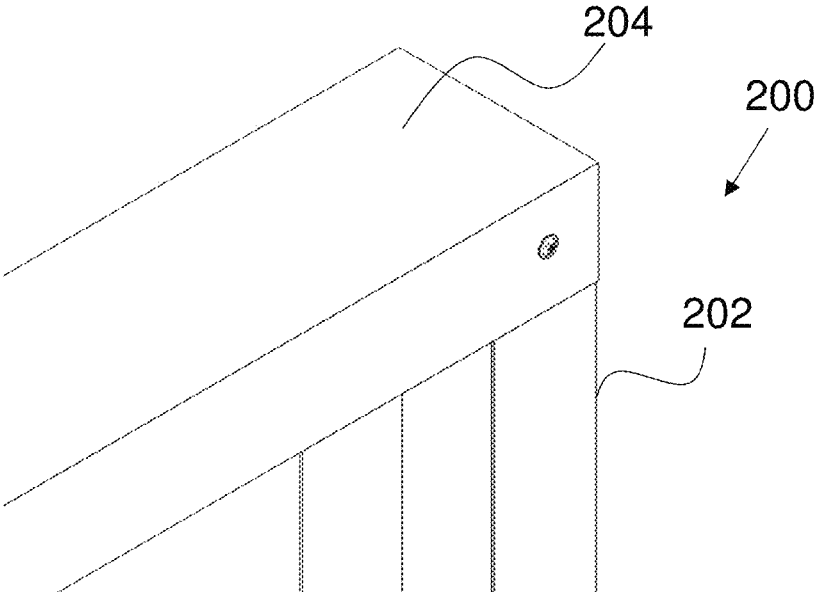
FIG. 36A (PRIOR ART)
FIG. 36A is a perspective view of a prior art steel frame connection.
Figure 36B:
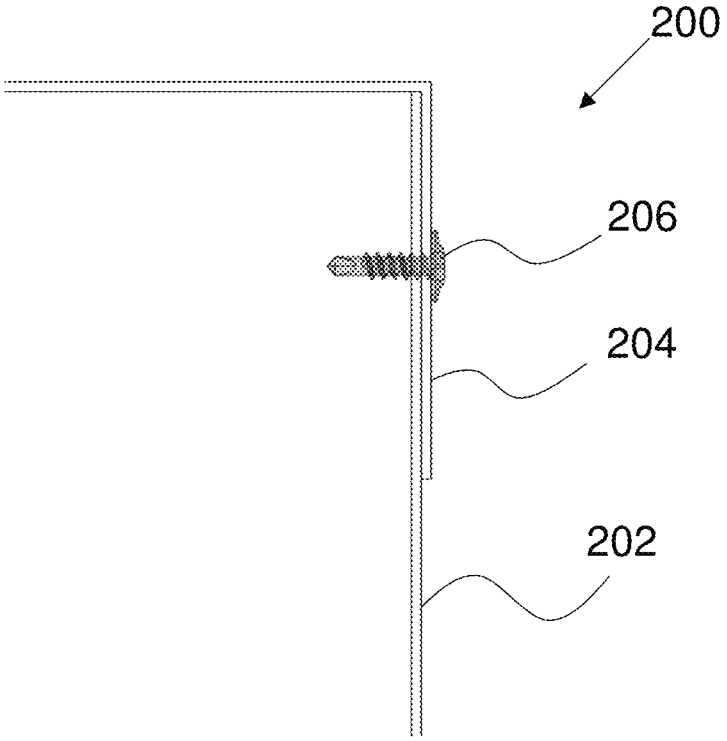
FIG. 36B (PRIOR ART)
FIG. 36B is a sectional view of the connection of FIG. 36A.

At the ground floor the load bearing thermally separated composite panel assembly 100 or the load bearing thermally separated composite panel assembly 20 may be provided with an elongate weather flap 148 as shown in FIGS. 34 and 35. The floor slab 150 has a step 152 formed therein. The plenum 28 extends downwardly over the step 152. The elongate weather flap 148 is operably attached to the plenum 28 and extends downwardly therefrom and engages the step 152. The elongate weather flap 148 may be made from silicone.

Generally speaking, the systems described herein are directed to thermally separated composite panels. Various embodiments and aspects of the disclosure are described in the detailed description. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein the "operably connected" or "operably attached" means that the two elements are connected or attached either directly or indirectly. Accordingly, the items need not be directly connected or attached but may have other items connected or attached therebetween.

What is claimed is:

1. A light steel framing plenum comprising:

a horizontal plenum member having a pair of horizontal plenum flanges and horizontal plenum web, the horizontal plenum flanges having dimpled screw holes formed therein;

a vertical plenum member being attached to the horizontal plenum member, the vertical plenum member having a pair of vertical plenum flanges and a vertical plenum web therebetween, the vertical plenum flanges each having a step formed therein for receiving the horizontal plenum flanges from the attached horizontal plenum member; and a plurality of screws attaching the horizontal plenum member to the vertical plenum member, whereby the light steel framing plenum provides a generally flat surface for attachment thereto, and wherein the vertical plenum member further includes a pair of vertical web lips extending inwardly from the vertical web at each end thereof and wherein each horizontal web includes at least one dimpled screw hole formed therein and further including screws for attaching the pair of vertical web lips of the vertical plenum member to the horizontal web.

* * * * *